US009362659B2

(12) United States Patent
Jones et al.

(10) Patent No.: US 9,362,659 B2
(45) Date of Patent: Jun. 7, 2016

(54) ELECTRICAL CONNECTOR TERMINAL

(71) Applicant: DELPHI TECHNOLOGIES, INC., Troy, MI (US)

(72) Inventors: Leslie L. Jones, Garrettsville, OH (US); Nicole L. Liptak, Cortland, OH (US); John L. Wicks, Cortland, OH (US)

(73) Assignee: Delphi Technologies, Inc., Troy, MI (US)

( * ) Notice: Subject to any disclaimer, the term of this patent is extended or adjusted under 35 U.S.C. 154(b) by 56 days.

(21) Appl. No.: 14/101,488

(22) Filed: Dec. 10, 2013

(65) Prior Publication Data

US 2015/0162697 A1 Jun. 11, 2015

(51) Int. Cl.

| | |
|---|---|
| ***H01R 13/648*** | (2006.01) |
| ***H01R 13/516*** | (2006.01) |
| ***H01R 13/04*** | (2006.01) |
| ***H01R 9/05*** | (2006.01) |
| ***H01R 9/053*** | (2006.01) |

(Continued)

(52) U.S. Cl.

CPC ..... *H01R 13/516* (2013.01); *H01R 9/053* (2013.01); *H01R 9/0518* (2013.01); *H01R 13/04* (2013.01); *H01R 13/432* (2013.01); *H01R 13/6582* (2013.01); *H01R 24/28* (2013.01); *H01R 4/185* (2013.01); *H01R 13/50* (2013.01); *H01R 13/627* (2013.01); *H01R 2103/00* (2013.01)

(58) Field of Classification Search

CPC ..... H01R 4/2445; H01R 4/24; H01R 4/2404; H01R 9/031; H01R 9/032; H01R 13/648

USPC ..... 439/607.01, 352, 345, 346, 362, 364, 439/619, 678, 699.1, 708, 723, 290, 850, 439/852, 660, 578

See application file for complete search history.

(56) References Cited

U.S. PATENT DOCUMENTS 5,139,434 A * 8/1992 Goodman ..... 439/399
6,186,837 B1 2/2001 Abe (Continued)

FOREIGN PATENT DOCUMENTS

DE 201 04 233 U1 5/2001
DE 10 2005 004241 A1 8/2006

(Continued)

OTHER PUBLICATIONS

European Search Report dated Apr. 8, 2015.

*Primary Examiner* — Abdullah Riyami
*Assistant Examiner* — Harshad Patel
(74) *Attorney, Agent, or Firm* — Robert J. Myers

(57) ABSTRACT

An electrical connector shield configured to be attached to a shielded wire cable having a conductive wire cable and a shield conductor surrounding the wire cable that is separated from the wire cable by an inner insulator. The shielded wire cable further has an insulative jacket surrounding the outer shield. The electrical shield connector includes a connection portion for connection with a corresponding mating electrical connector shield and an attachment portion having a conductor crimp wing for attachment to the outer shield and an insulator crimp wing for attachment to the insulative jacket. The insulator crimp wing defines a prong having a pointed end to penetrate the insulative jacket. The end of the prong penetrates the insulative jacket but does not penetrate the inner insulator. The connector shield may define a protruding triangular lock tang to engage a lock edge within a cavity of an electrical connector body.

4 Claims, 25 Drawing Sheets

(51) Int. Cl.

| | |
|---|---|
| ***H01R 13/432*** | (2006.01) |
| ***H01R 13/6582*** | (2011.01) |
| ***H01R 24/28*** | (2011.01) |
| *H01R 103/00* | (2006.01) |
| *H01R 4/18* | (2006.01) |
| *H01R 13/50* | (2006.01) |
| *H01R 13/627* | (2006.01) |

(56) References Cited

U.S. PATENT DOCUMENTS

| | | | | |
|---|---|---|---|---|
| 6,328,601 | B1 * | 12/2001 | Yip et al. | 439/607.08 |
| 6,358,091 | B1 * | 3/2002 | Lo et al. | 439/607.06 |
| 6,994,596 | B2 * | 2/2006 | Katsuma et al. | 439/746 |
| 2004/0166731 | A1 * | 8/2004 | Laub et al. | 439/578 |
| 2005/0086590 | A1 * | 4/2005 | Lee et al. | 715/505 |
| 2005/0227551 | A1 * | 10/2005 | Tabata et al. | 439/852 |
| 2010/0035485 | A1 * | 2/2010 | Okamura et al. | 439/877 |
| 2011/0159721 | A1 * | 6/2011 | Glick et al. | 439/389 |

FOREIGN PATENT DOCUMENTS

| | | | |
|---|---|---|---|
| EP | 1 005 106 | A2 | 5/2000 |
| EP | 1 174 948 | A1 | 1/2002 |
| WO | 2010/041823 | A2 | 4/2010 |

* cited by examiner

| STANDARD | RISE TIME | NOMINAL IMPEDANCE | MINIMUM IMPEDANCE | MAXIMUM IMPEDANCE |
|---|---|---|---|---|
| HDMI 1.3 | 200 ps | 100 Ω | 85 Ω | 115 Ω |
| USB 3.0 | 50 ps | 90 Ω | 76.5 Ω | 105 Ω |
| COMBINED | 50 ps | 95 Ω | 85 Ω | 105 Ω |

FIG. 9

| | | |
|---|---|---|
| DIELECTRIC STRENGTH | 0.5 KILOVOLTS/MINUTE | |
| MAXIMUM DC RESISTANCE AT 20° C | 350W/km | |
| IMPEDENCE (TDR) | 95 Ω | |
| INTERPAIR SKEW | < 15 ps/METER | |
| ATTENUATION/7 METERS | ≤ 1.5 DECIBELS(dB) | @ < 100 MEGAHERTZ (MHz) |
| | ≤ 5 dB | @ < 100 MHz - 1250 MHz |
| | ≤ 7.5 dB | @ < 1250 MHz - 2500 MHz |
| | ≤ 25 dB | @ < 2500 MHz - 7500 MHz |
| BENDING RADIUS | ≤ 31 mm | |

FIG. 10

ELECTRICAL CONNECTOR TERMINAL

TECHNICAL FIELD OF INVENTION

The invention generally relates to electrical connector terminals, and more particularly relates to an electrical connector terminal configured to inhibiting rotation of the electrical connector terminal about the longitudinal axis the wire cable to which it is attached and/or configured to lock into a cavity of a connector body by a triangular lock tang protruding from the electrical terminal.

BACKGROUND OF THE INVENTION

The increase in digital data processor speeds has led to an increase in data transfer speeds. Transmission media used to connect electronic components to the digital data processors must be constructed to efficiently transmit the high speed digital signals between the various components. Wired media, such as fiber optic cable, coaxial cable, or twisted pair cable may be suitable in applications where the components being connected are in fixed locations and are relatively close proximity, e.g. separated by less than 100 meters. Fiber optic cable provides a transmission medium that can support data rates of up to nearly 100 Gb/s and is practically immune to electromagnetic interference. Coaxial cable typically supports data transfer rates up to 100 Megabits per second (Mb/s) and has good immunity to electromagnetic interference. Twisted pair cable can support data rates of up to about 5 Gb/s, although these cables typically require multiple twisted pairs within the cable dedicated to transmit or receive lines. The conductors of the twisted pair cables offer good resistance to electromagnetic interference which can be improved by including shielding for the twisted pairs within the cable.

Data transfer protocols such as Universal Serial Bus (USB) 3.0 and High Definition Multimedia Interface (HDMI) 1.3 require data transfer rates at or above 5 Gb/s. Existing coaxial cable cannot support data rates near this speed. Both fiber optic and twisted pair cables are capable of transmitting data at these transfer rates, however fiber optic cables are significantly more expensive than twisted pair, making them less attractive for cost sensitive applications that do not require the high data transfer rates and electromagnetic interference immunity.

Infotainment systems and other electronic systems in automobiles and trucks are beginning to require cables capable of carrying high data rate signals. Automotive grade cables must not only be able to meet environmental requirements (e.g. thermal and moisture resistance), they must also be flexible enough to be routed in a vehicle wiring harness and have a low mass to help meet vehicle fuel economy requirements. Therefore, there is a need for a wire cable with a high data transfer rate that has low mass and is flexible enough to be packaged within a vehicle wiring harness, while meeting cost targets that cannot currently be met by fiber optic cable. Although the particular application given for this wire cable is automotive, such a wire cable would also likely find other applications, such as aerospace, industrial control, or other data communications.

The subject matter discussed in the background section should not be assumed to be prior art merely as a result of its mention in the background section. Similarly, a problem mentioned in the background section or associated with the subject matter of the background section should not be assumed to have been previously recognized in the prior art.

The subject matter in the background section merely represents different approaches, which in and of themselves may also be inventions.

BRIEF SUMMARY OF THE INVENTION

In accordance with one embodiment of this invention, an electrical connector shield is provided. The electrical connector shield is configured to be attached to an end of a shielded wire cable having a conductive wire cable and a shield conductor longitudinally surrounding the conductive wire cable that is separated from the conductive wire cable by an inner insulator. The shielded wire cable further has an insulative jacket that at least partially surrounds the shield conductor. The electrical shield connector includes a connection portion that is configured for connection with a corresponding mating electrical connector shield and an attachment portion having a conductor crimp wing configured for attachment to an end of the shield conductor and an insulator crimp wing configured for attachment to an end of the insulative jacket. The insulator crimp wing defines a prong having a pointed end that is configured to penetrate the insulative jacket but is configured to not penetrate the inner insulator. The connection portion defines a shroud that is configured to longitudinally surround an electrical terminal attached to the conductive wire cable. The shroud may define an embossment proximate a location of a connection between the electrical terminal and the conductive wire cable. This embossment increases a distance between the connection and the shroud.

The electrical connector shield may be configured to be disposed within a cavity of an electrical connector body. In this case, the electrical connector shield defines a triangular lock tang protruding from the electrical connector shield that is configured to engage a lock edge within the cavity of the electrical connector body. The triangular lock tang includes a first free edge extending from the electrical connector body and defining an acute angle relative to a longitudinal axis of the electrical connector shield, and a second free edge also extending from the electrical connector body and substantially perpendicular to the longitudinal axis and wherein the first free edge and the second free edge protrude from the electrical connector shield.

Further features and advantages of the invention will appear more clearly on a reading of the following detailed description of the preferred embodiment of the invention, which is given by way of non-limiting example only and with reference to the accompanying drawings.

BRIEF DESCRIPTION OF THE SEVERAL VIEWS OF THE DRAWING

The present invention will now be described, by way of example with reference to the accompanying drawings, in which:

FIG. 9 is a chart illustrating the signal rise time and desired cable impedance of several high speed digital transmission standards;

FIG. 10 is a chart illustrating various performance characteristics of the wire cable of FIG. 1-7 in accordance with several embodiments.

DETAILED DESCRIPTION OF THE INVENTION

Presented herein is a wire cable assembly that is capable of carrying digital signals at rates up to 5 Gigabits per second (Gb/s) (5 billion bits per second) to support both USB 3.0 and HDMI 1.3 performance specifications. The wire cable assembly includes a wire cable having a pair of conductors (wire pair) and a conductive sheet and braided conductor to isolate the wire pair from electromagnetic interference and determine the characteristic impedance of the cable. The wire pair is encased within dielectric belting that helps to provide a consistent radial distance between the wire pair and the shield. The belting may also help to maintain a consistent twist angle between the wire pair if they are twisted. The consistent radial distance between the wire pair and the shield and the consistent twist angle provides a wire cable with more consistent impedance. The wire cable assembly may also include an electrical receptacle connector having a mirrored pair of plug terminals connected to the wire pair and/or an electrical plug connector having a mirrored pair of receptacle terminals connected to the wire pair that is configured to mate with the plug terminals of the plug connector. The receptacle and plug terminals each have a generally rectangular cross section and when the first and second electrical connectors are mated, the major widths of the receptacle terminals are substantially perpendicular to the major widths of the plug terminals and the contact points between the receptacle and plug terminals are external to the receptacle and plug terminals. Both the receptacle and plug connectors include a shield that longitudinally surrounds the receptacle or plug terminals and is connected to the braided conductor of the wire cable. The wire cable assembly may also include an insulative connector body that contains the receptacle or plug terminals and shield.

Figure 1:
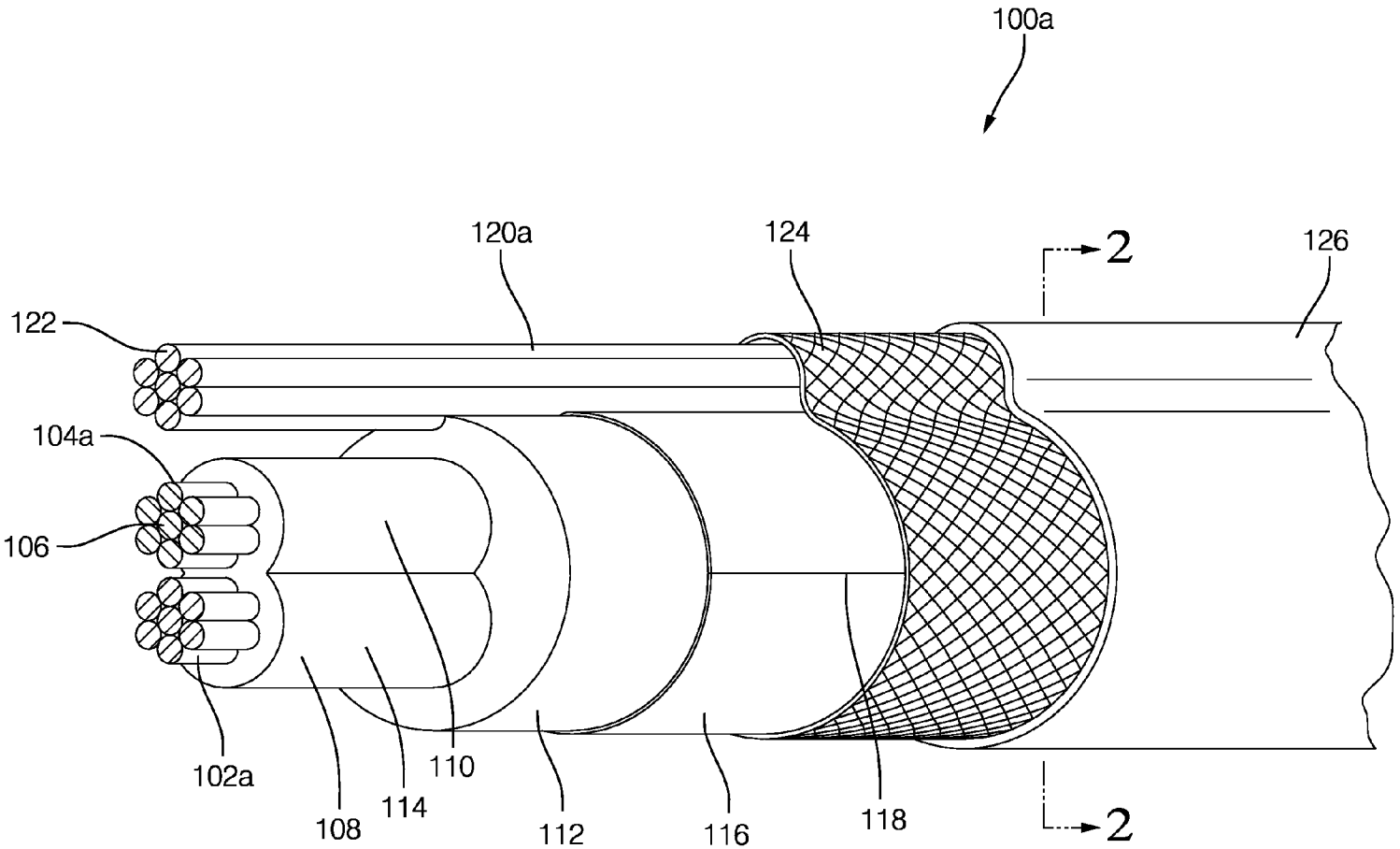
FIG. 1 is perspective cut away drawing of a wire cable of a wire cable assembly having stranded conductors in accordance with one embodiment.
Figure 2:
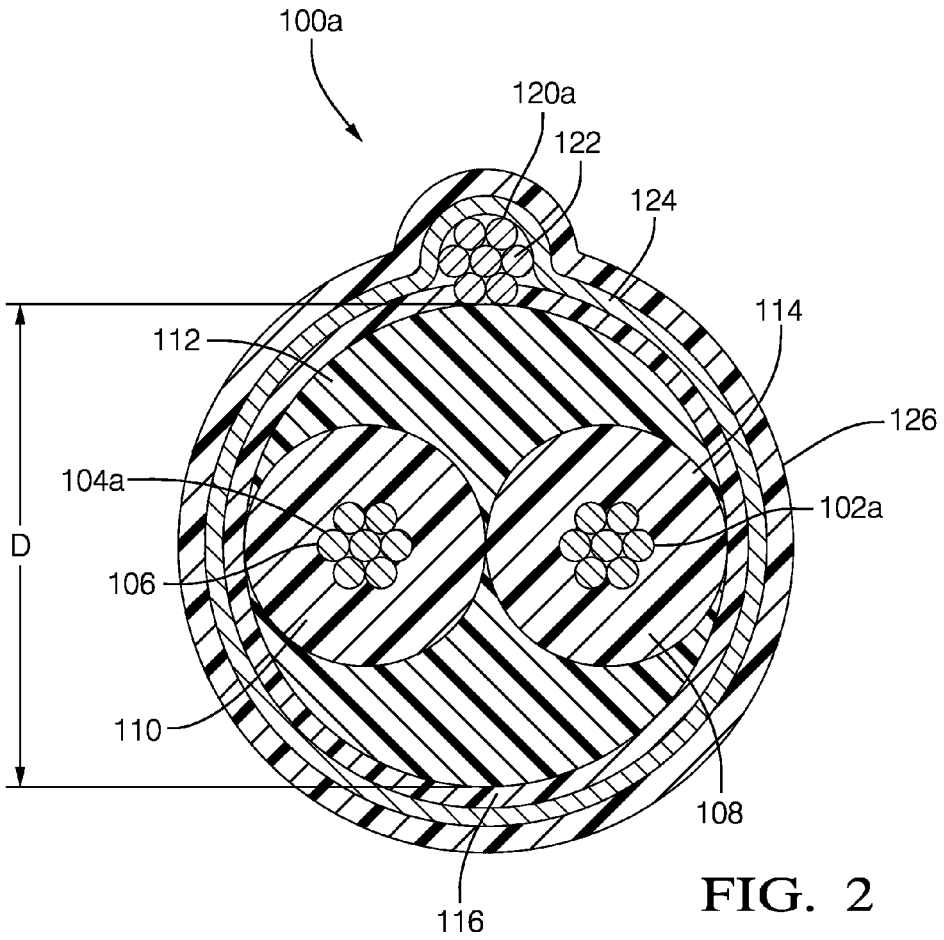
FIG. 2 is a cross section drawing of the wire cable of FIG. 1 in accordance with one embodiment.

FIGS. 1 and 2 illustrate a non-limiting example of a wire cable 100*a* used in the wire cable assembly. The wire cable 100*a* includes a central pair of conductors comprising a first inner conductor, hereinafter referred to as the first conductor 102*a* and a second inner conductor, hereinafter referred to as the second conductor 104*a*. The first and second conductors 102*a*, 104*a* are formed of a conductive material with superior conductivity, such as unplated copper or silver plated copper. As used herein, copper refers to elemental copper or a copper-based alloy. Further, as used herein, silver refers to elemental silver or a silver-based alloy. The design, construction, and sources of copper and silver plated copper conductors are well known to those skilled in the art. In the example shown in FIGS. 1 and 2, the first and second conductors 102*a*, 104*a* if wire cable 100*a* may each consist of seven wire strands 106. Each of the wire strands 106 of the first and second conductors 102*a*, 104*a* may be characterized as having a diameter of 0.12 millimeters (mm), which is generally equivalent to 28 American Wire Gauge (AWG) stranded wire. Alternatively, the first and second conductors 102*a*, 104*a* may be formed of stranded wire having a smaller gauge, such as 30 AWG or 32 AWG.

As shown in FIG. 2, the central pair of first and second conductors 102*a*, 104*a* is longitudinally twisted over a length L, for example once every 8.89 mm. Twisting the first and second conductors 102*a*, 104*a* provides the benefit of reducing low frequency electromagnetic interference of the signal carried by the central pair. However, the inventors have discovered that satisfactory signal transmission performance may also be provided by a wire cable wherein the first and second conductors 102*a*, 104*a* are not twisted about one about the other. Not twisting the first and second conductors 102*a*, 104*a* may provide the benefit of reducing manufacturing cost of the wire cable by eliminating the twisting process.

Referring once more to FIGS. 1 and 2, each of the first and second conductors 102*a*, 104*a* are enclosed within a respective first dielectric insulator and a second dielectric insulator, hereafter referred to as the first and second insulators 108, 110. The first and second insulators 108, 110 are bonded together. The first and second insulators 108, 110 run the entire length of the wire cable 100*a*, except for portions that are removed at the ends of the cable in order to terminate the wire cable 100*a*. The first and second insulators 108, 110 are formed of a flexible dielectric material, such as polypropylene. The first and second insulators 108, 110 may be characterized as having a thickness of about 0.85 mm.

Figure 3:
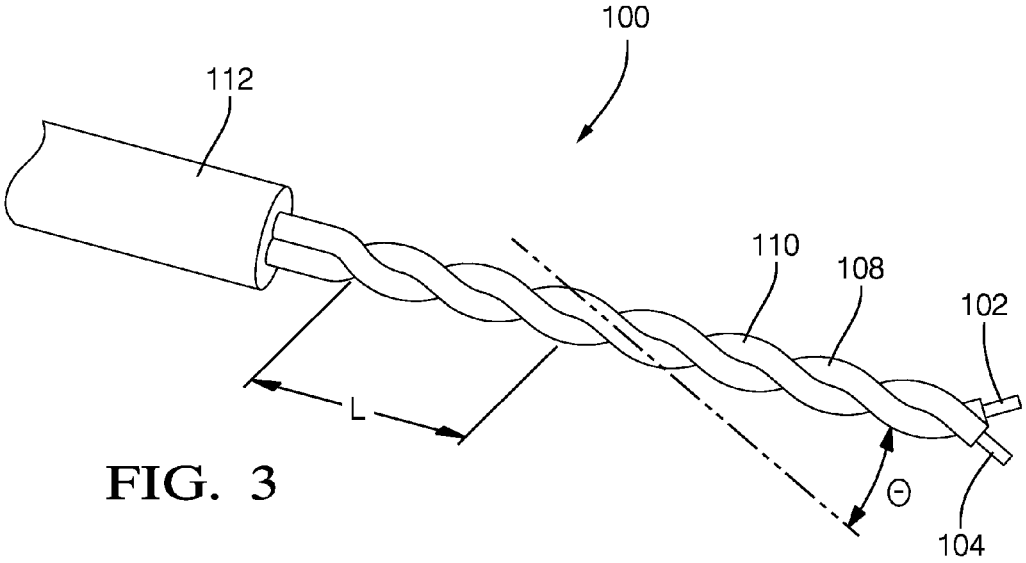
FIG. 3 is a partial cut away drawing of the wire cable illustrating the twist length of the wire cable of FIG. 1 in accordance with one embodiment.

Bonding the first insulator 108 to the second insulators 110 helps to maintain the spacing between the first and second conductors 102*a*, 104*a*. It may also keep a twist angle Θ (see FIG. 3) between the first and second conductors 102*a*, 104*a* consistent when the first and second conductors 102*a*, 104*a* are twisted. The methods required to manufacture a pair of conductors with bonded insulators are well known to those skilled in the art.

The first and second conductors 102*a*, 104*a* and the first and second insulators 108, 110 are completely enclosed within a third dielectric insulator, hereafter referred to as the belting 112, except for portions that are removed at the ends of the cable in order to terminate the wire cable 100*a*. The first and second insulators 108, 110 and the belting 112 together form a dielectric structure 113.

The belting 112 is formed of a flexible dielectric material, such as polyethylene. As illustrated in FIG. 2, the belting may be characterized as having a diameter D of 2.22 mm. A release agent 114, such as a talc-based powder, may be applied to an outer surface of the bonded first and second insulators 108, 110 in order to facilitate removal of the belting 112 from the first and second insulators 108, 110 when ends of the first and second insulators 108, 110 are stripped from the first and second conductors 102*a*, 104*a* to form terminations of the wire cable 100*a*.

The belting 112 is completely enclosed within a conductive sheet, hereafter referred to as the inner shield 116, except for portions that may be removed at the ends of the cable in order to terminate the wire cable 100*a*. The inner shield 116 is longitudinally wrapped in a single layer about the belting 112, so that it forms a single seam 118 that runs generally parallel to the central pair of first and second conductors 102*a*, 104*a*. The inner shield 116 is not spirally wrapped or helically wrapped about the belting 112. The seam edges of the inner shield 116 may overlap, so that the inner shield 116 covers at least 100 percent of an outer surface of the belting 112. The inner shield 116 is formed of a flexible conductive material, such as aluminized biaxially oriented PET film. Biaxially oriented polyethylene terephthalate film is commonly known by the trade name MYLAR and the aluminized biaxially oriented PET film will hereafter be referred to as aluminized MYLAR film. The aluminized MYLAR film has a conductive aluminum coating applied to only one of the major surfaces; the other major surface is non-aluminized and therefore non-conductive. The design, construction, and sources for single-sided aluminized MYLAR films are well known to those skilled in the art. The non-aluminized surface of the inner shield 116 is in contact with an outer surface of the belting 112. The inner shield 116 may be characterized as having a thickness of less than or equal to 0.04 mm.

The belting 112 provides the advantage of maintaining a consistent radial distance between the first and second conductor 102*a*, 104*a* and the inner shield 116. The belting 112 further provides an advantage of keeping the twist angle Θ of the first and second conductors 102*a*, 104*a* consistent. Shielded twisted pair cables found in the prior art typically only have air as a dielectric between the twisted pair and the shield. Both the distance between first and second conductors 102*a*, 104*a* and the inner shield 116 and the effective twist angle Θ of the first and second conductors 102*a*, 104*a* affect the wire cable impedance. Therefore a wire cable with more consistent radial distance between the first and second conductors 102*a*, 104*a* and the inner shield 116 provides more consistent impedance. A more consistent twist angle Θ of the first and second conductors 102*a*, 104*a* also provides more consistent impedance.

Alternatively, a wire cable may be envisioned incorporating a single dielectric structure encasing the first and second insulators to maintain a consistent lateral distance between the first and second insulators and a consistent radial distance between the first and second insulators and the inner shield. The dielectric structure may also keep the twist angle Θ of the first and second conductors consistent.

As shown in FIGS. 1 and 2, the wire cable 100*a* additionally includes a ground conductor, hereafter referred to as the drain wire 120*a* that is disposed outside of the inner shield 116. The drain wire 120*a* extends generally parallel to the first and second conductors 102*a*, 104*a* and is in intimate contact or at least in electrical communication with the aluminized outer surface of the inner shield 116. In the example of FIGS. 1 and 2, the drain wire 120*a* of wire cable 100*a* may consist of seven wire strands 122. Each of the wire strands 122 of the drain wire 120*a* may be characterized as having a diameter of 0.12 mm, which is generally equivalent to 28 AWG stranded wire. Alternatively, the drain wire 120*a* may be formed of stranded wire having a smaller gauge, such as 30 AWG or 32 AWG. The drain wire 120*a* is formed of a conductive wire, such as an unplated copper wire or a tin plated copper wire. The design, construction, and sources of copper and tin plated copper conductors are well known to those skilled in the art.

As illustrated in FIGS. 1 and 2, the wire cable 100*a* further includes a braided wire conductor, hereafter referred to as the outer shield 124, enclosing the inner shield 116 and the drain wire 120*a*, except for portions that may be removed at the ends of the cable in order to terminate the wire cable 100*a*. The outer shield 124 is formed of a plurality of woven conductors, such as copper or tin plated copper. As used herein, tin refers to elemental tin or a tin-based alloy. The design, construction, and sources of braided conductors used to provide such an outer shield are well known to those skilled in the art. The outer shield 124 is in intimate contact or at least in electrical communication with both the inner shield 116 and the drain wire 120*a*. The wires forming the outer shield 124 may be in contact with at least 65 percent of an outer surface of the inner shield 116. The outer shield 124 may be characterized as having a thickness less than or equal to 0.30 mm.

The wire cable 100*a* shown in FIGS. 1 and 2 further includes an outer dielectric insulator, hereafter referred to as the jacket 126. The jacket 126 encloses the outer shield 124, except for portions that may be removed at the ends of the cable in order to terminate the wire cable 100*a*. The jacket 126 forms an outer insulation layer that provides both electrical insulation and environmental protection for the wire cable 100*a*. The jacket 126 is formed of a flexible dielectric material, such as cross-linked polyethylene. The jacket 126 may be characterized as having a thickness of about 0.1 mm.

The wire cable 100*a* is constructed so that the inner shield 116 is tight to the belting 112, the outer shield 124 is tight to the drain wire 120*a* and the inner shield 116, and the jacket 126 is tight to the outer shield 124 so that the formation of air gaps between these elements is minimized or compacted. This provides the wire cable 100*a* with improved magnetic permeability.

The wire cable 100*a* may be characterized as having a characteristic impedance of 95 Ohms.

Figure 4:
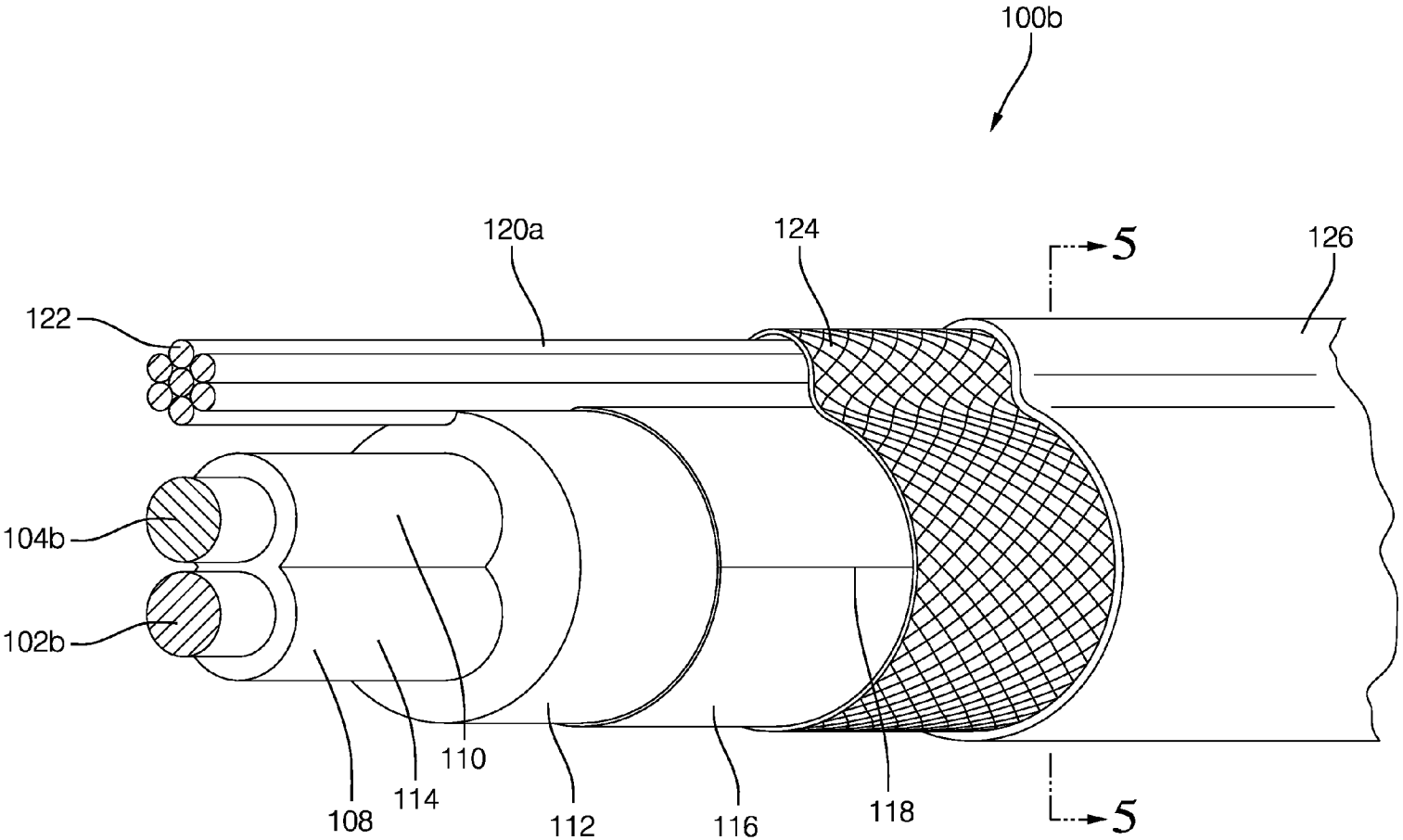
FIG. 4 is perspective cut away drawing of a wire cable of a wire cable assembly having solid conductors in accordance with another embodiment.
Figure 5:
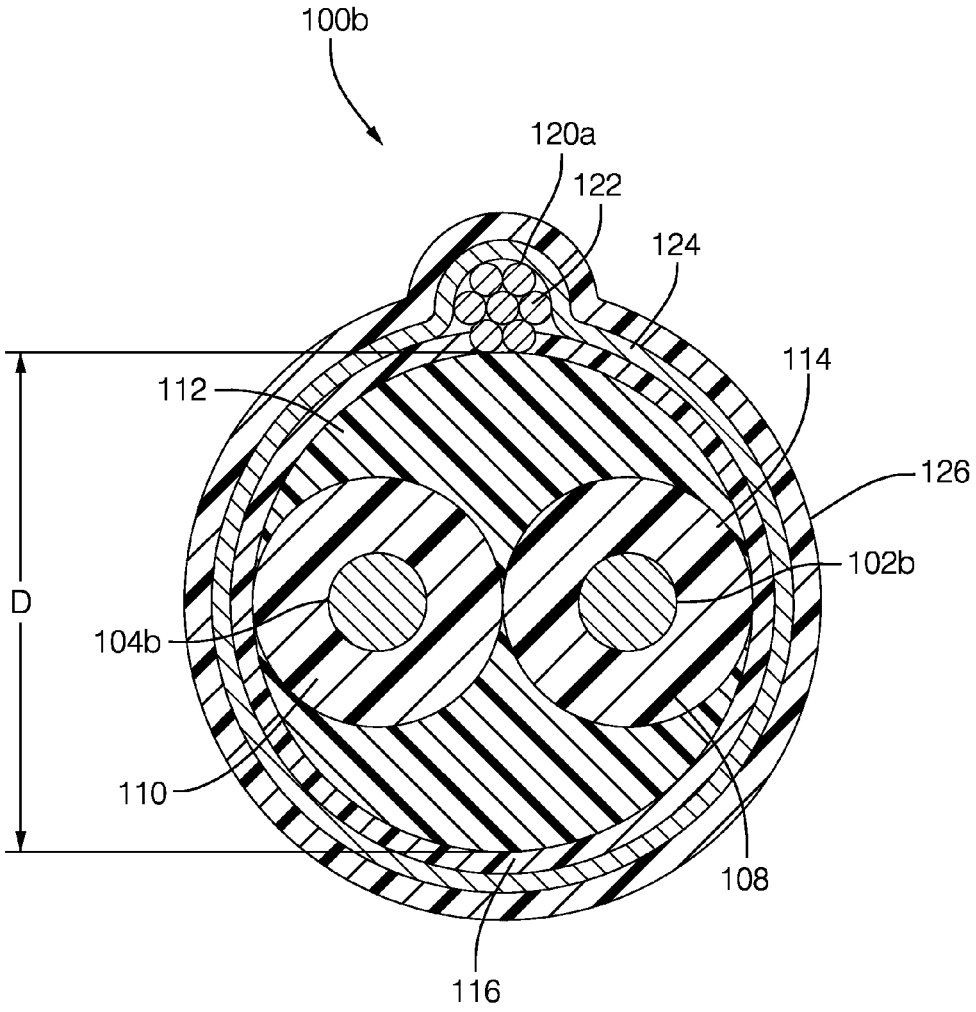
FIG. 5 is a cross section drawing of the wire cable of FIG. 4 in accordance with another embodiment.

FIGS. 4 and 5 illustrate another non-limiting example of a wire cable 100*b* for transmitting electrical digital data signals. The wire cable 100*b* illustrated in FIGS. 4 and 5 is identical in construction to the wire cable 100*a* shown in FIGS. 1 and 2, with the exception that the first and second conductors 102*b*, 104*b* each comprise a solid wire conductor, such as a bare (non-plated) copper wire or silver plated copper wire having a cross section of about 0.321 square millimeters ($mm^2$), which is generally equivalent to 28 AWG solid wire. Alternatively, the first and second conductors 102*b*, 104*b* may be formed of a solid wire having a smaller gauge, such as 30 AWG or 32 AWG. The wire cable 100*b* may be characterized as having an impedance of 95 Ohms.

Figure 6:
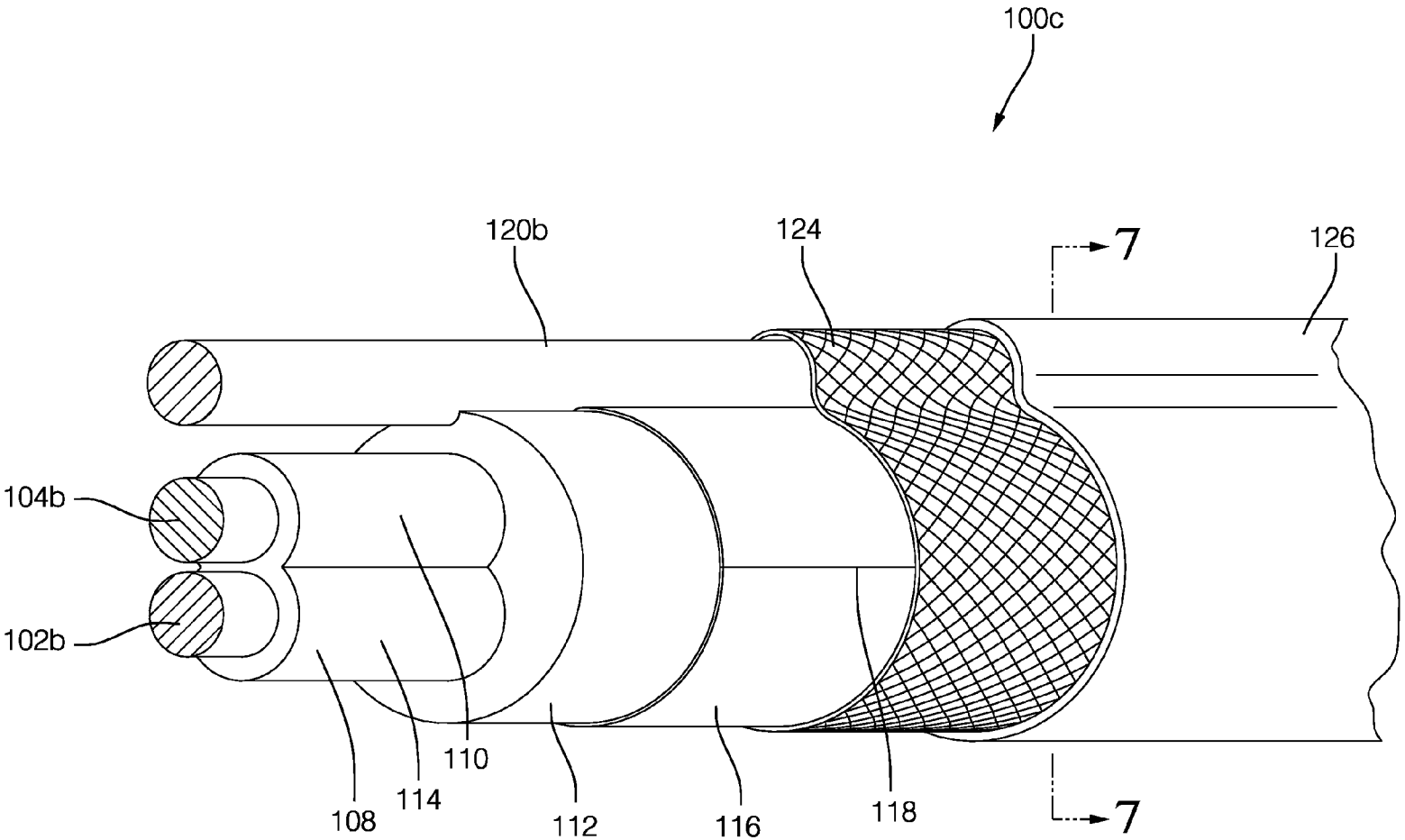
FIG. 6 is a perspective cut away drawing of a wire cable of a wire cable assembly having a solid drain wire in accordance with yet another embodiment.
Figure 7:
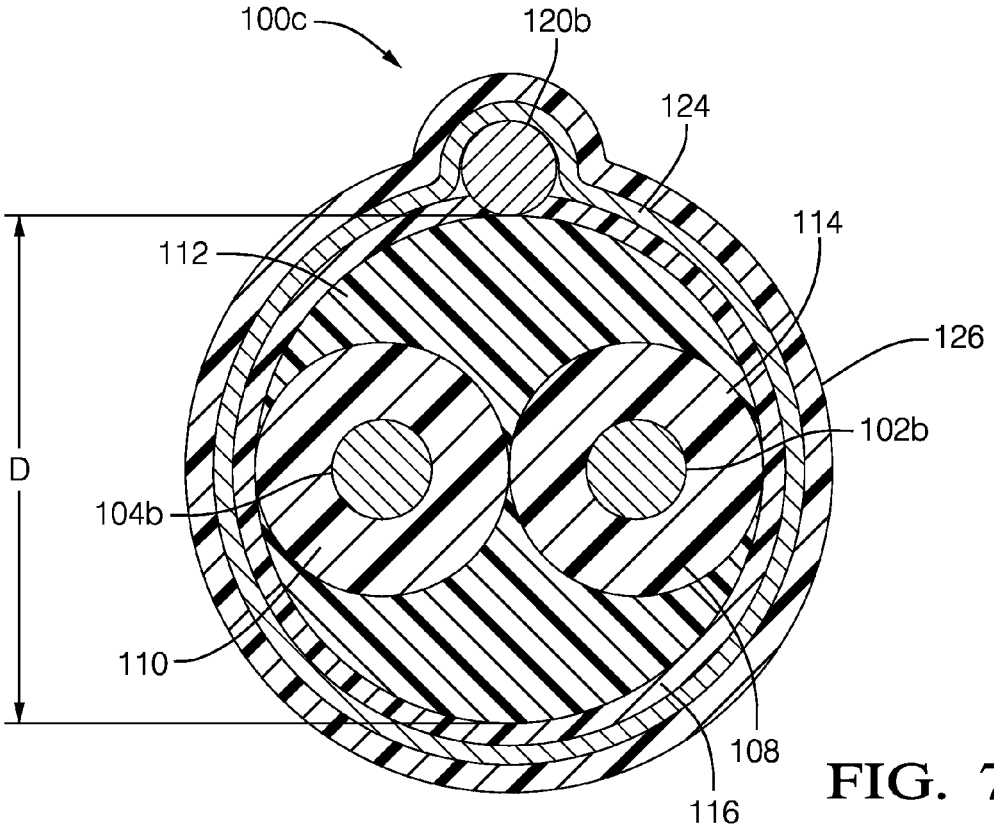
FIG. 7 is a cross section drawing of the wire cable of FIG. 6 in accordance with yet another embodiment.

FIGS. 6 and 7 illustrate another non-limiting example of a wire cable 100*c* for transmitting electrical digital data signals. The wire cable 100*c* illustrated in FIGS. 6 and 7 is identical in construction to the wire cable 100*b* shown in FIGS. 4 and 5, with the exception that the drain wire 120*b* comprises a solid wire conductor, such as an unplated copper conductor, tin plated copper conductor, or silver plated copper conductor having a cross section of about 0.321 $mm^2$, which is generally equivalent to 28 AWG solid wire. Alternatively, the drain wire 120*b* may be formed of solid wire having a smaller gauge, such as 30 AWG or 32 AWG. The wire cable 100*c* may be characterized as having an impedance of 95 Ohms.

Figure 8:
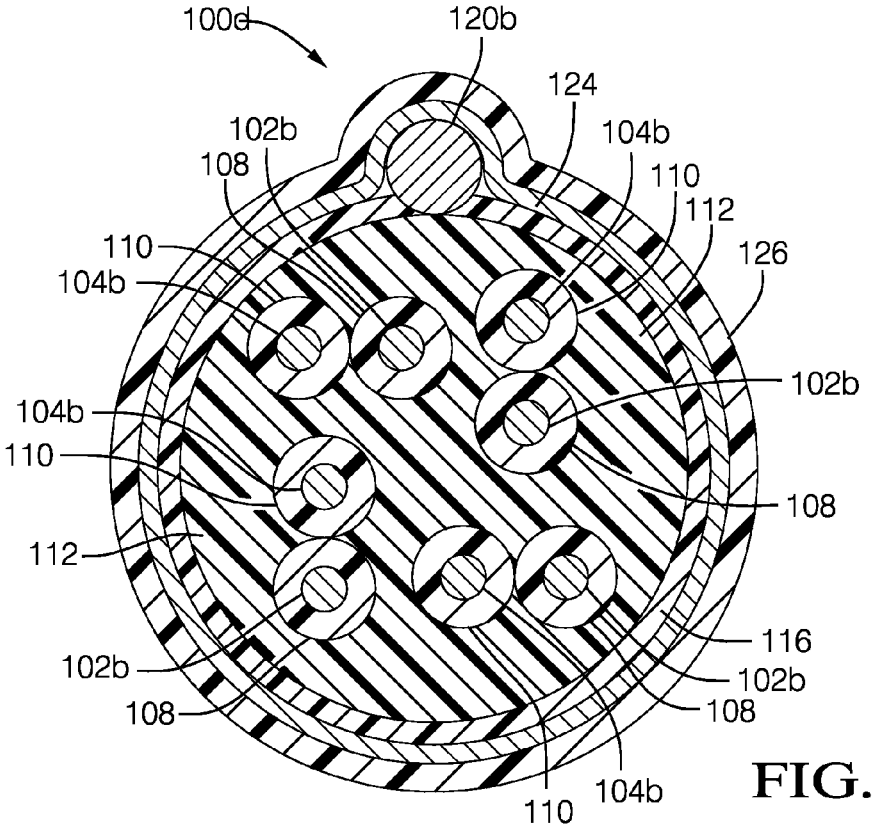
FIG. 8 is a cross section drawing of the wire cable of FIG. 6 in accordance with yet another embodiment.

FIG. 8 illustrates yet another non-limiting example of a wire cable 100*d* for transmitting electrical digital data signals. The wire cable 100*d* illustrated in FIG. 5 is similar to the construction to the wire cables 100*a*, 100*b*, 100*c* shown in FIGS. 1-7, however, wire cable 100*d* includes multiple pairs of first and second conductors 102*b*, 104*b*. The belting 112 also eliminates the need for a spacer to maintain separation of the wire pairs as seen in the prior art for wire cables having multiple wire pair conductors. The example illustrated in FIG. 8 includes solid wire conductors 102*b*, 104*b*, and 120*b*. However, alternative embodiments may include stranded wires 102*a*, 104*a*, and 120*a*.

FIG. 9 illustrates the requirements for signal rise time (in picoseconds (ps)) and differential impedance (in Ohms (Ω)) for the USB 3.0 and HDMI 1.3 performance specifications. FIG. 9 also illustrates the combined requirements for a wire cable capable of simultaneously meeting both USB 3.0 and HDMI 1.3 standards. The wire cable 100*a*-100*c* is expected to meet the combined USB 3.0 and HDMI 1.3 signal rise time and differential impedance requirements shown in FIG. 9.

FIG. 10 illustrates the differential impedances that are expected for the wire cables 100*a*-100*c* over a signal frequency range of 0 to 7500 MHz (7.5 GHz).

Figure 11:
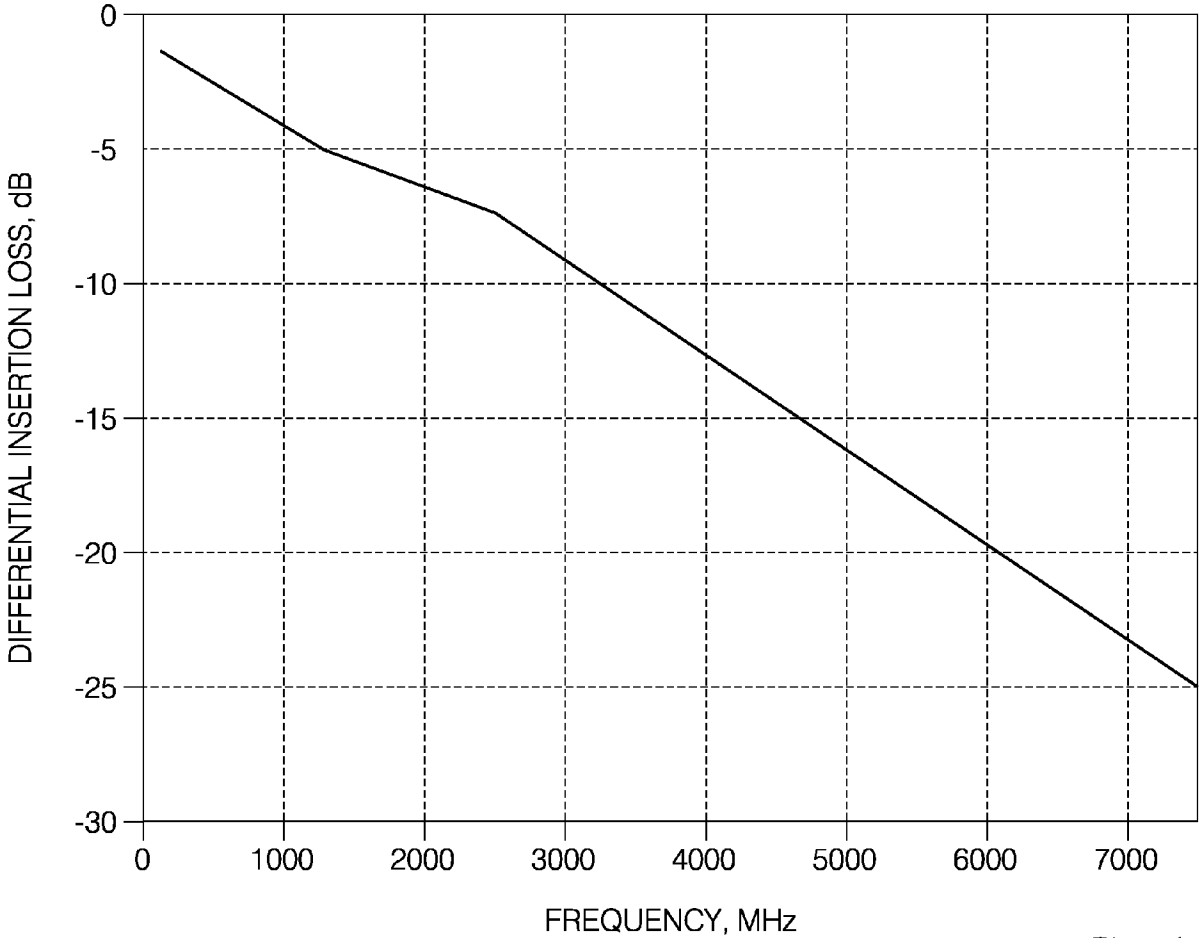
FIG. 11 is a graph of the differential insertion loss versus signal frequency of the wire cable of FIGS. 1-7 in accordance with several embodiments.

FIG. 11 illustrates the insertion losses that are expected for wire cable 100*a*-100*c* with a length of 7 m over the signal frequency range of 0 to 7500 MHz (7.5 GHz).

Therefore, as shown in FIGS. 10 and 11, the wire cable 100*a*-100*c* having a length of up to 7 meters are expected to be capable of transmitting digital data at a speed of up to 5 Gigabits per second with an insertion loss of less than 20 dB.

Figure 12:
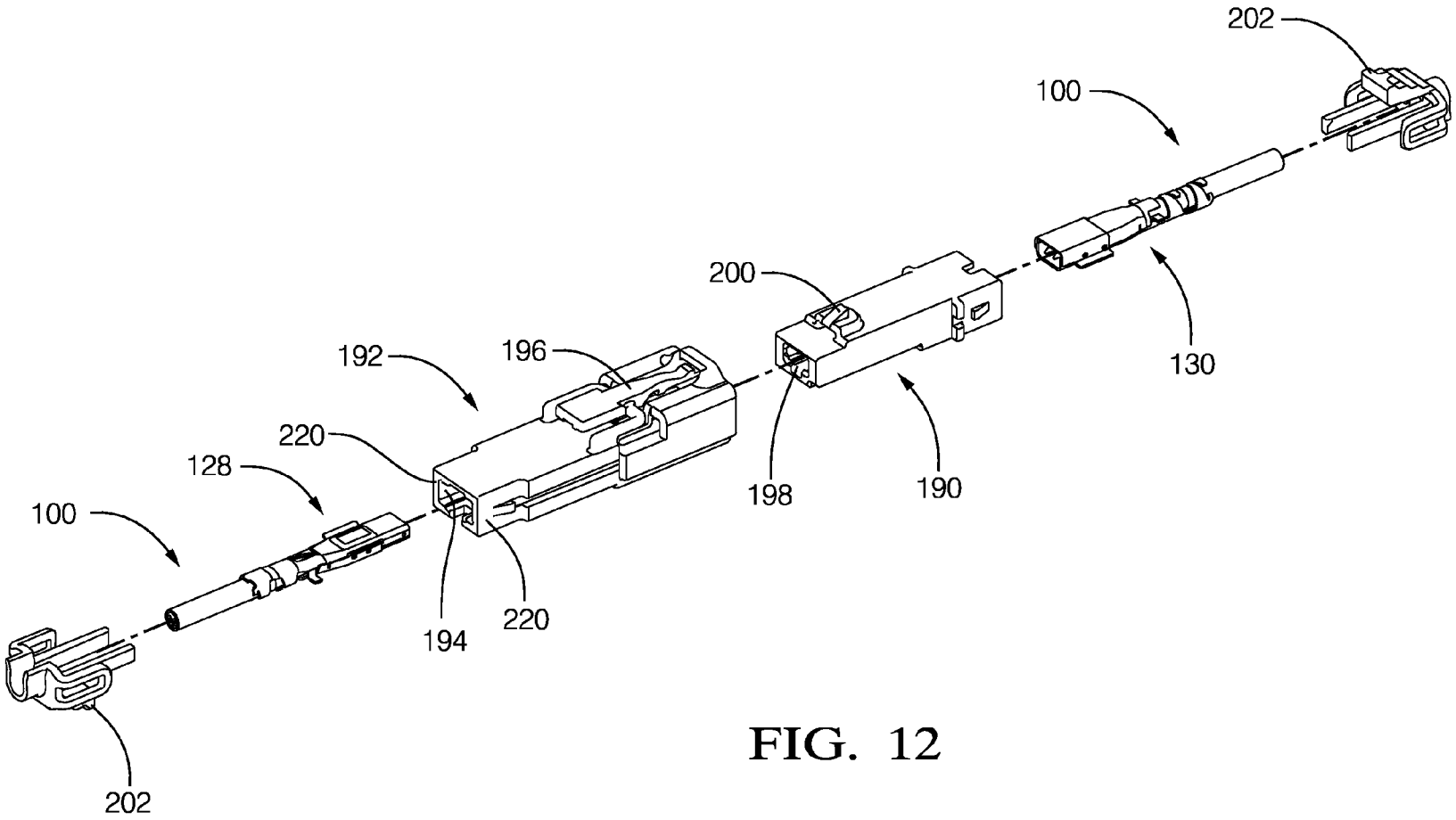
FIG. 12 is an exploded perspective view of a wire cable assembly in accordance with one embodiment.

As illustrated in the non-limiting example of FIG. 12, the wire cable assembly also includes an electrical connector. The connector may be a receptacle connector 128 or a plug connector 130 configured to accept the receptacle connector 128.

Figures 13, 14:
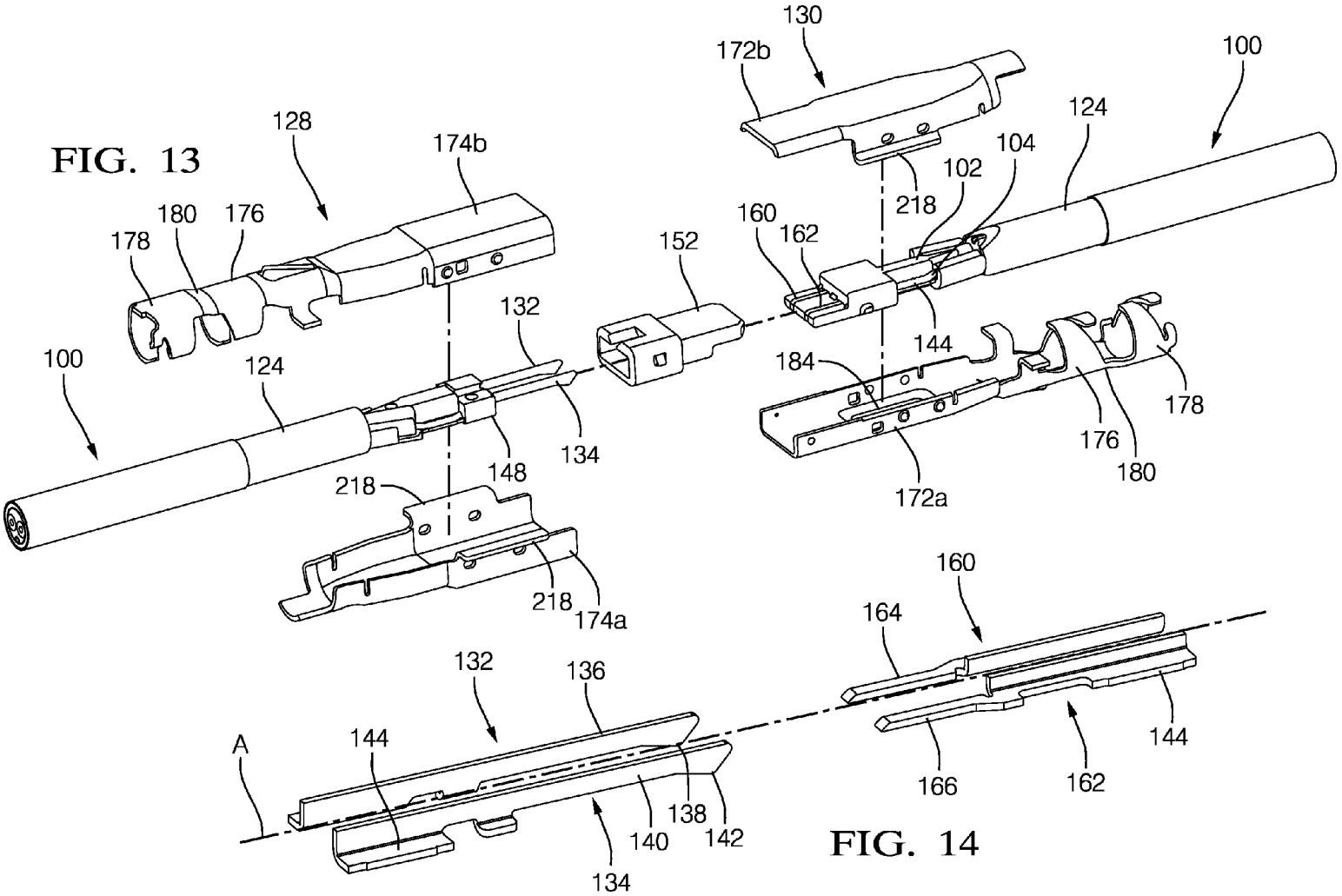
FIG. 13 is an exploded perspective view of a subset of the components of the wire cable assembly of FIG. 12 in accordance with one embodiment.
FIG. 14 is a perspective view of the receptacle and plug terminals of the wire cable assembly of FIG. 12 in accordance with one embodiment.

As illustrated in FIG. 13, the receptacle connector 128 include two terminals, a first receptacle terminal 132 connected to a first inner conductor 102 and a second receptacle terminal 134 connected to a second inner conductor (not shown due to drawing perspective) of the wire cable 100. As shown in FIG. 14, the first receptacle terminal 132 includes a first cantilever beam portion 136 that has a generally rectangular cross section and defines a convex first contact point 138 that depends from the first cantilever beam portion 136 near the free end of the first cantilever beam portion 136. The second receptacle terminal 134 also includes a similar second cantilever beam portion 140 having a generally rectangular cross section and defining a convex second contact point 142 depending from the second cantilever beam portion 140 near the free end of the second cantilever beam portion 140. The first and second receptacle terminals 132, 134 each comprise an attachment portion 144 that is configured to receive the end of an inner conductor of the wire cable 100 and provide a surface for attaching the first and second inner conductors 102, 104 to the first and second receptacle terminals 132, 134. As shown in FIG. 14, the attachment portion 144 defines an L shape. The first and second receptacle terminals 132, 134 form a mirrored terminal pair that has bilateral symmetry about the longitudinal axis A and are substantially parallel to the longitudinal axis A and each other. In the illustrated embodiment, the distance between the first cantilever beam portion 136 and the second cantilever beam portion 140 is 2.85 mm, center to center.

Figure 15:
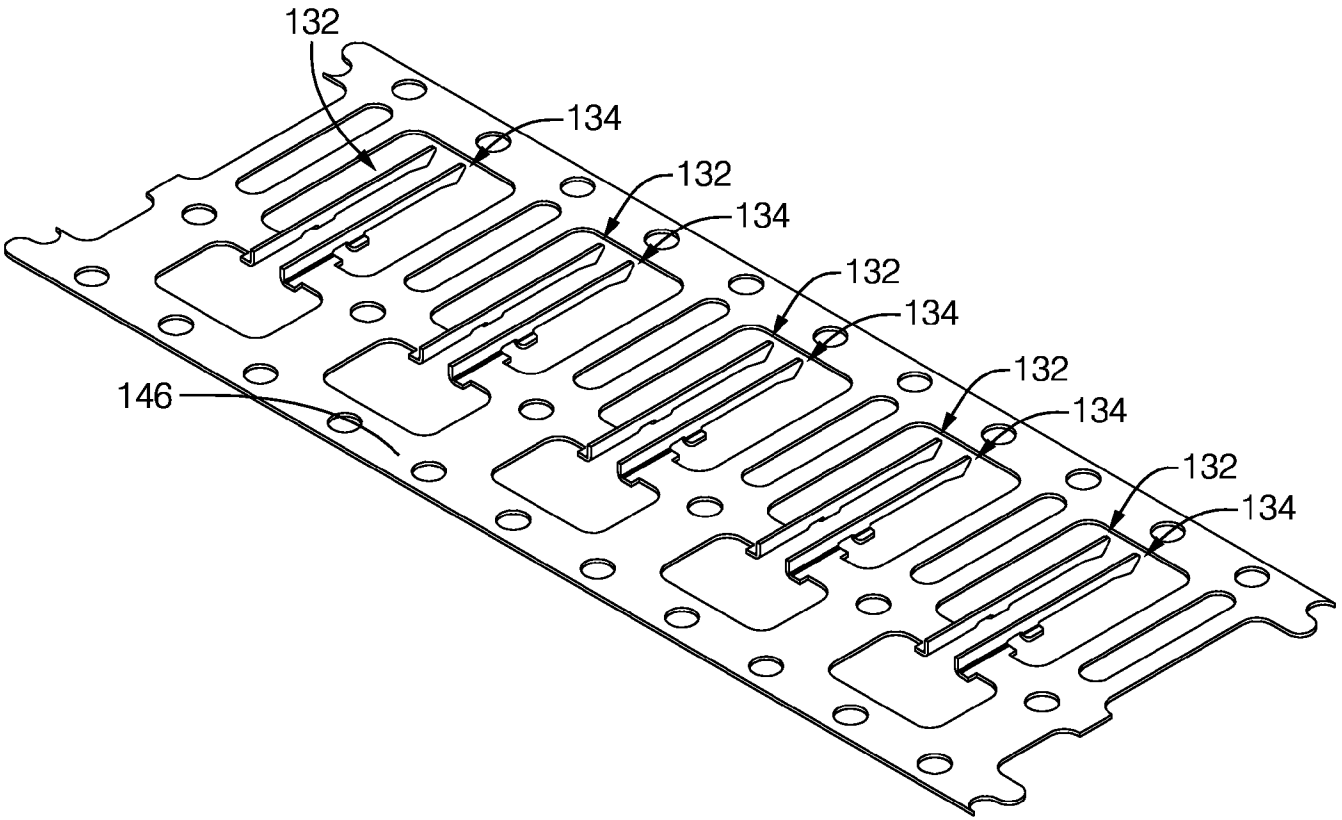
FIG. 15 is a perspective view of the receptacle terminals of the wire cable assembly of FIG. 12 contained in a carrier strip in accordance with one embodiment.

As illustrated in FIG. 15, the first and second receptacle terminals 132, 134 are formed from a sheet of conductive material by a stamping process that cuts out and bends the sheet to form the first and second receptacle terminals 132, 134. The stamping process also forms a carrier strip 146 to which the first and second receptacle terminals 132, 134 are attached. The first and second receptacle terminals 132, 134 are formed using a fine blanking process that provides a shear cut of at least 80% or greater through the stock thickness. This provides a smoother surface on the minor edges of the cantilever beam portions and the contact point that reduces connection abrasion between the receptacle connector 128 and the plug connector 130. The attachment portion 144 is then bent to the L shape in a subsequent forming operation.

Figure 16:
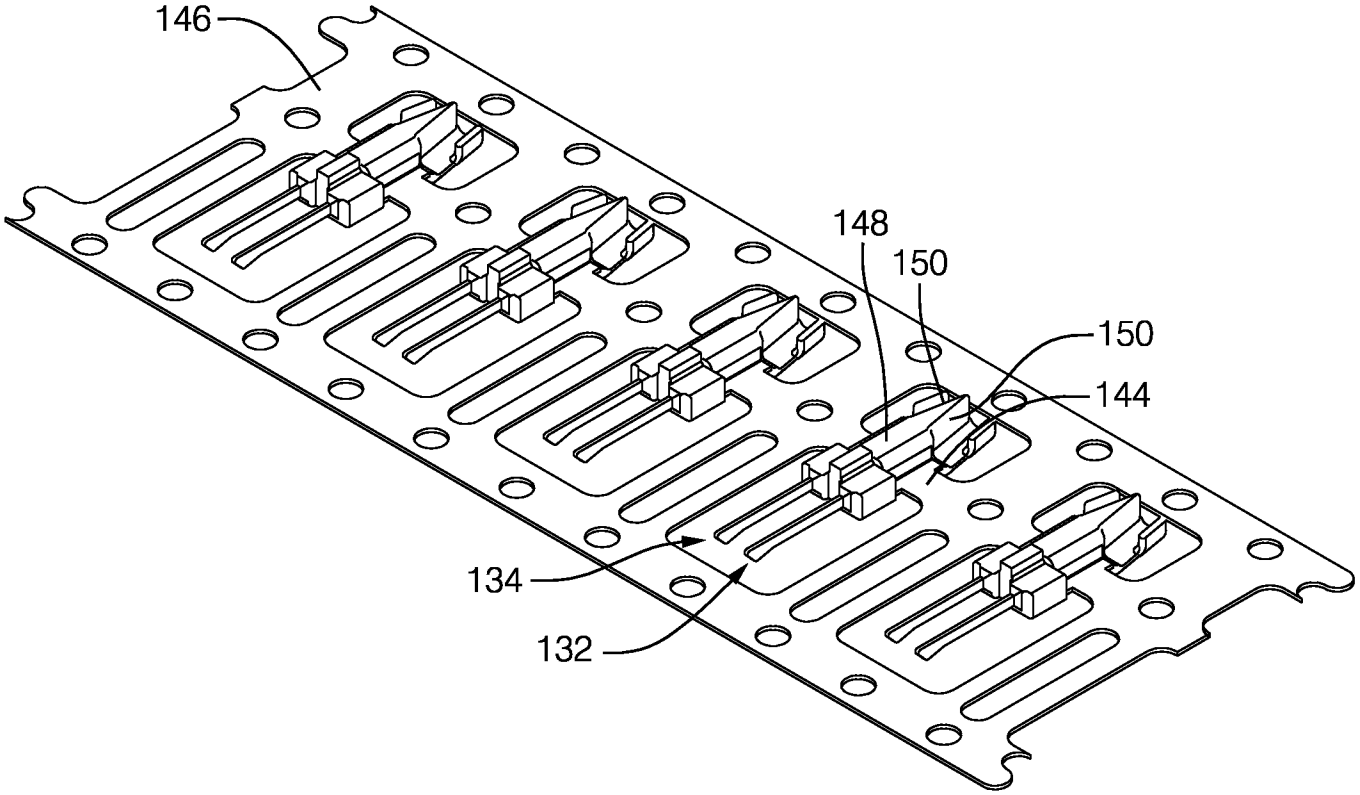
FIG. 16 is a perspective view of the receptacle terminals assembly of FIG. 15 encased within a receptacle terminal holder in accordance with one embodiment.

As illustrated in FIG. 16, first and second receptacle terminals 132, 134 remain attached to the carrier strip 146 for an insert molding process that forms a receptacle terminal holder 148 that partially encases the first and second receptacle terminal 132, 134. The receptacle terminal holder 148 maintains the spatial relationship between the first and second receptacle terminals 132, 134 after they are separated from the carrier strip 146. The receptacle terminal holder 148 also defines a pair of wire guide channels 150 that help to maintain a consistent separation between the first and second inner conductors 102, 104 as they transition from the wire cable 100 to the attachment portions 144 of the first and second receptacle terminals 132, 134. The receptacle terminal holder 148 is formed of a dielectric material, such as a liquid crystal polymer. This material offers performance advantages over other engineering plastics, such as polyamide or polybutylene terephthalate, for molding, processing, and electrical dielectric characteristics.

Figure 17:
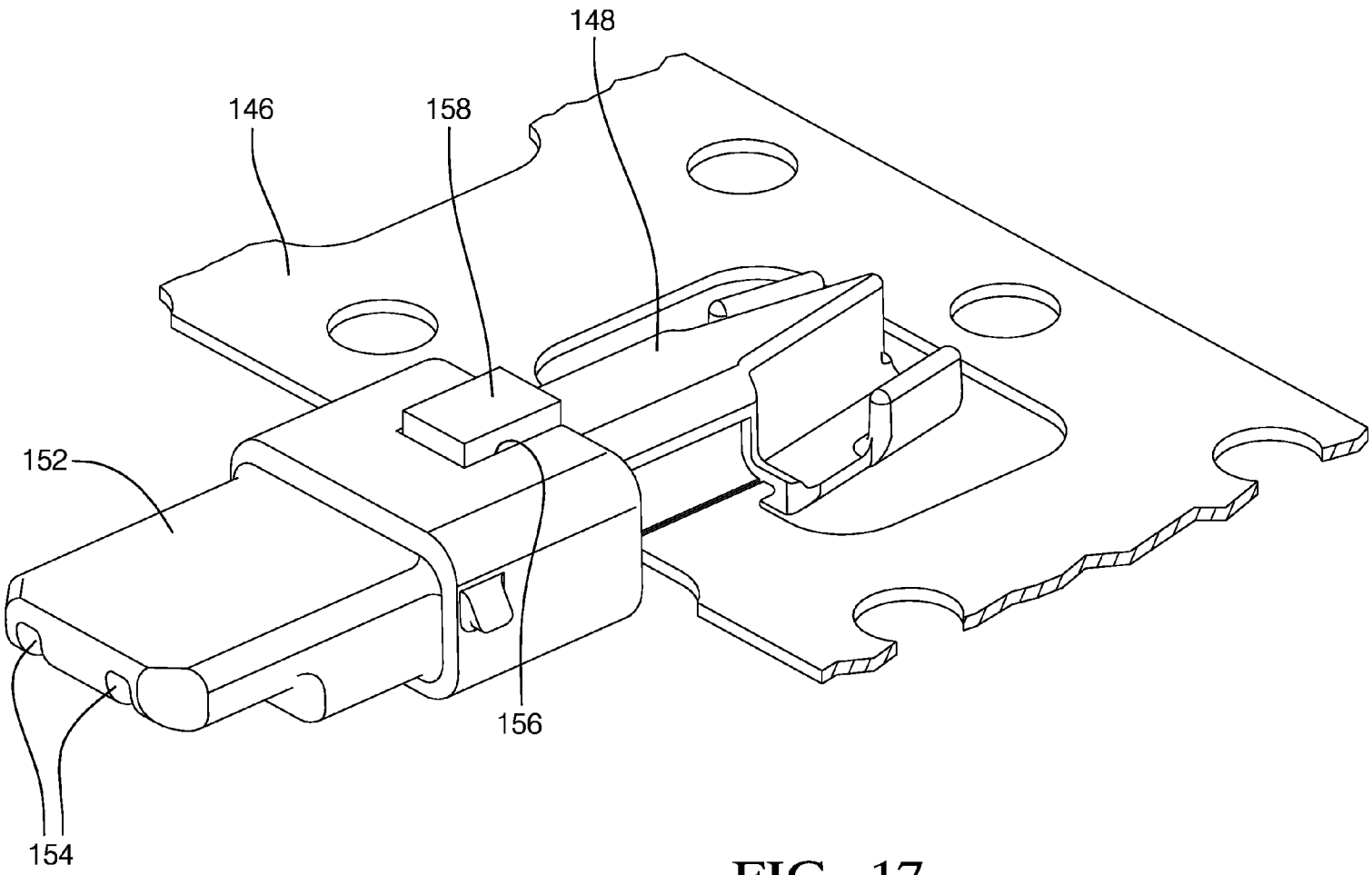
FIG. 17 is a perspective view of the receptacle terminals assembly of FIG. 16 including a receptacle terminal cover in accordance with one embodiment.

As illustrated in FIG. 17, a portion of the carrier strip 146 is removed and a receptacle terminal cover 152 is then attached to the receptacle terminal holder 148. The receptacle terminal cover 152 is configured to protect the first and second receptacle terminals 132, 134 from bending while the receptacle connector 128 is being handled and when the plug connector 130 is being connected or disconnected with the receptacle connector 128. The receptacle terminal cover 152 defines a pair of grooves 154 that allow the first and second cantilever beam portions 136, 140 to flex when the plug connector 130 is connected to the receptacle connector 128. The receptacle terminal cover 152 may also be formed of same liquid crystal polymer material as the receptacle terminal holder 148, although other dielectric materials may alternatively be used. The receptacle terminal holder 148 defines an elongate slot 156 that mated to an elongate post 158 defined by the receptacle terminal holder 148. The receptacle terminal cover 152 is joined to the receptacle terminal holder 148 by ultrasonically welding the post 158 within the slot 156. Alternatively, other means of joining the receptacle terminal holder 148 to the receptacle terminal cover 152 may be employed.

The remainder of the carrier strip 146 is removed from the first and second receptacle terminals 132, 134 prior to attaching the first and second inner conductors 102, 104 to the first and second receptacle terminals 132, 134.

Figure 18:
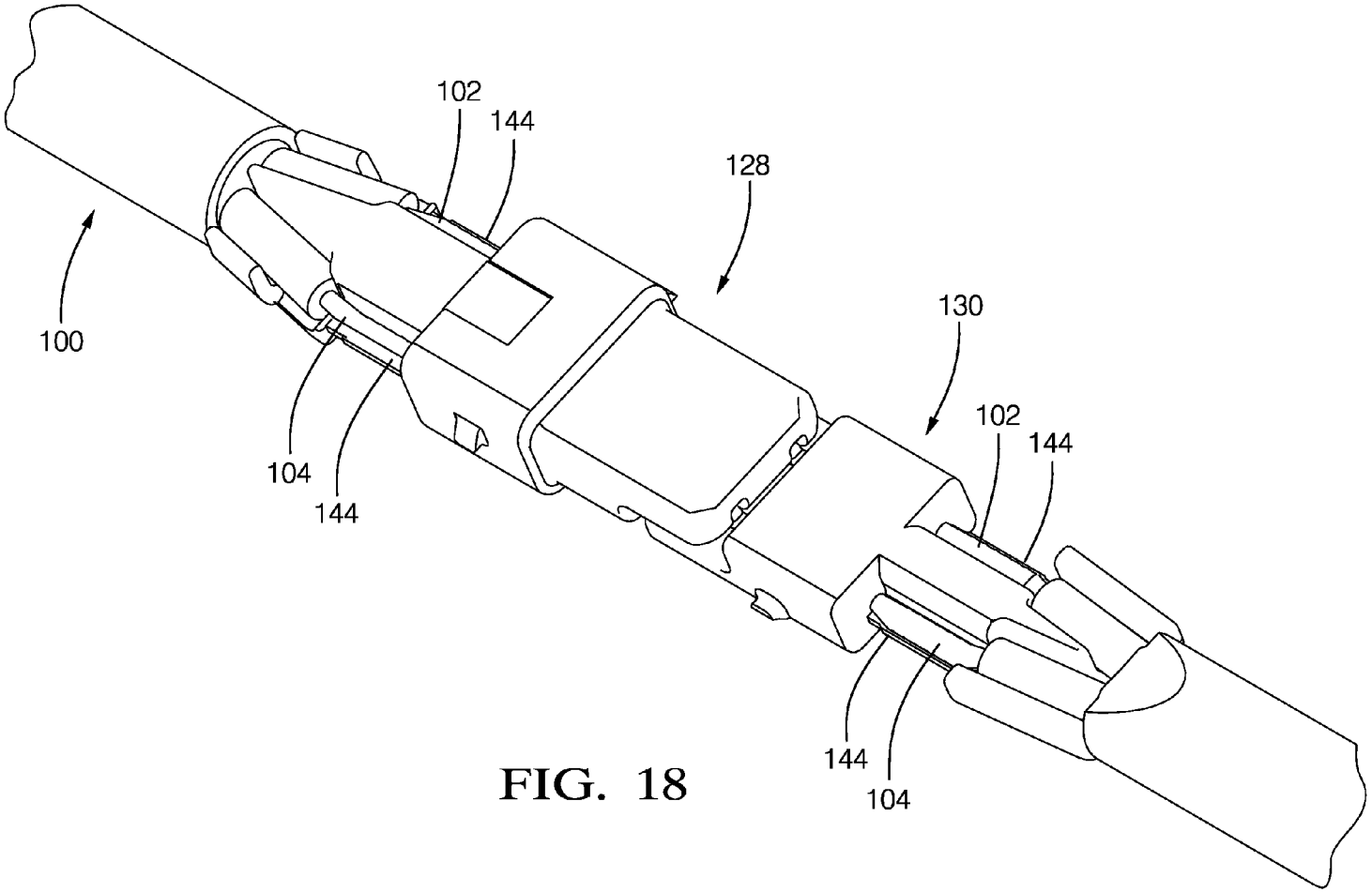
FIG. 18 is a perspective assembly view of the wire cable assembly of FIG. 13 in accordance with one embodiment.

As illustrated in FIG. 18, the first and second inner conductors 102, 104 are attached to the attachment portions 144 of the first and second receptacle terminals 132, 134 using an ultrasonic welding process. Sonically welding the conductors to the terminals allows better control of the mass of the joint between the conductor and the terminal than other joining processes such as soldering and therefore provides better control over the capacitance associated with the joint between the conductor and the terminal. It also avoids environmental issues caused by using solder.

Returning again to FIG. 13, the plug connector 130 also includes two terminals, a first plug terminal 160 connected to a first inner conductor 102 and a second plug terminal 162 connected to a second inner conductor (not shown) of the wire cable 100. As shown in FIG. 14, the first plug terminal 160 includes a first elongate planar portion 164 that has a generally rectangular cross section. The second plug terminal 162 also includes a similar second elongate planar portion 166. The planar portions of the plug terminals are configured to receive and contact the first and second contact points 138, 142 of the first and second receptacle terminals 132, 134. The free ends of the planar portions have a beveled shape to allow the mating first and second receptacle terminals 132, 134 to ride up and over free ends of the first and second planar portions 164, 166 when the plug connector 130 and receptacle connector 128 are mated. The first and second plug terminals 160, 162 each comprise an attachment portion 144 similar to the attachment portions 144 of the first and second receptacle terminals 132, 134 that are configured to receive the ends of the first and second inner conductors 102, 104 and provide a surface for attaching the first and second inner conductors 102, 104 to the first and second plug terminals 160, 162. As shown in FIG. 14, the attachment portion 144 defines an L shape. The first and second plug terminals 160, 162 form a mirrored terminal pair that has bilateral symmetry about the longitudinal axis A and are substantially parallel to the longitudinal axis A and each other. In the illustrated embodiment, the distance between the first planar portion and the second planar portion is 2.85 mm, center to center. The inventors have observed through data obtained from computer simulation that the mirrored parallel receptacle terminals and plug terminals have a strong effect on the impedance and insertion loss of the wire cable assembly.

Figure 19:
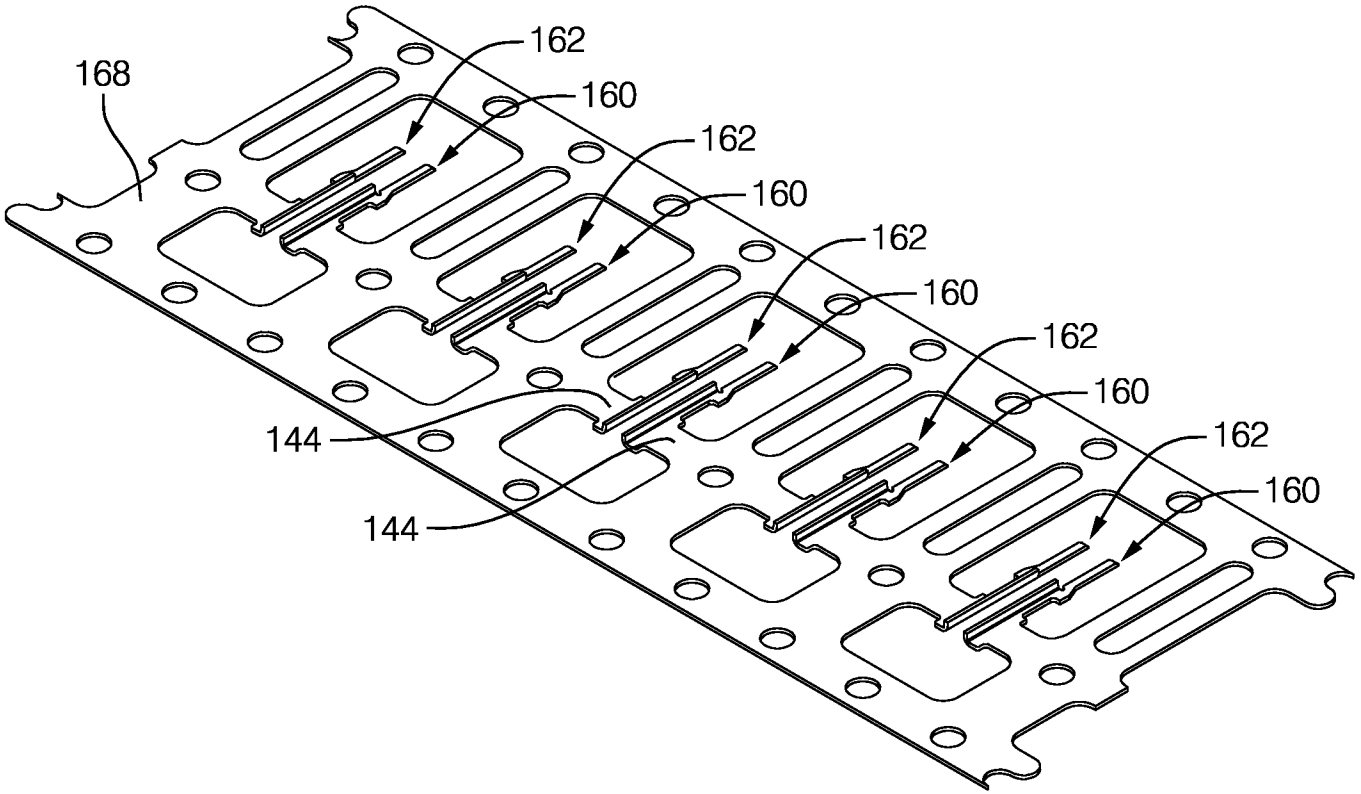
FIG. 19 is a perspective view of the plug terminals of the wire cable assembly of FIG. 12 contained in a carrier strip in accordance with one embodiment.

As illustrated in FIG. 19, the plug terminals are formed from a sheet of conductive material by a stamping process that cuts out and bends the sheet to form the plug terminals. The stamping process also forms a carrier strip 168 to which the plug terminals are attached. The attachment portion 144 is then bent to the L shape in a subsequent forming operation.

Figure 20:
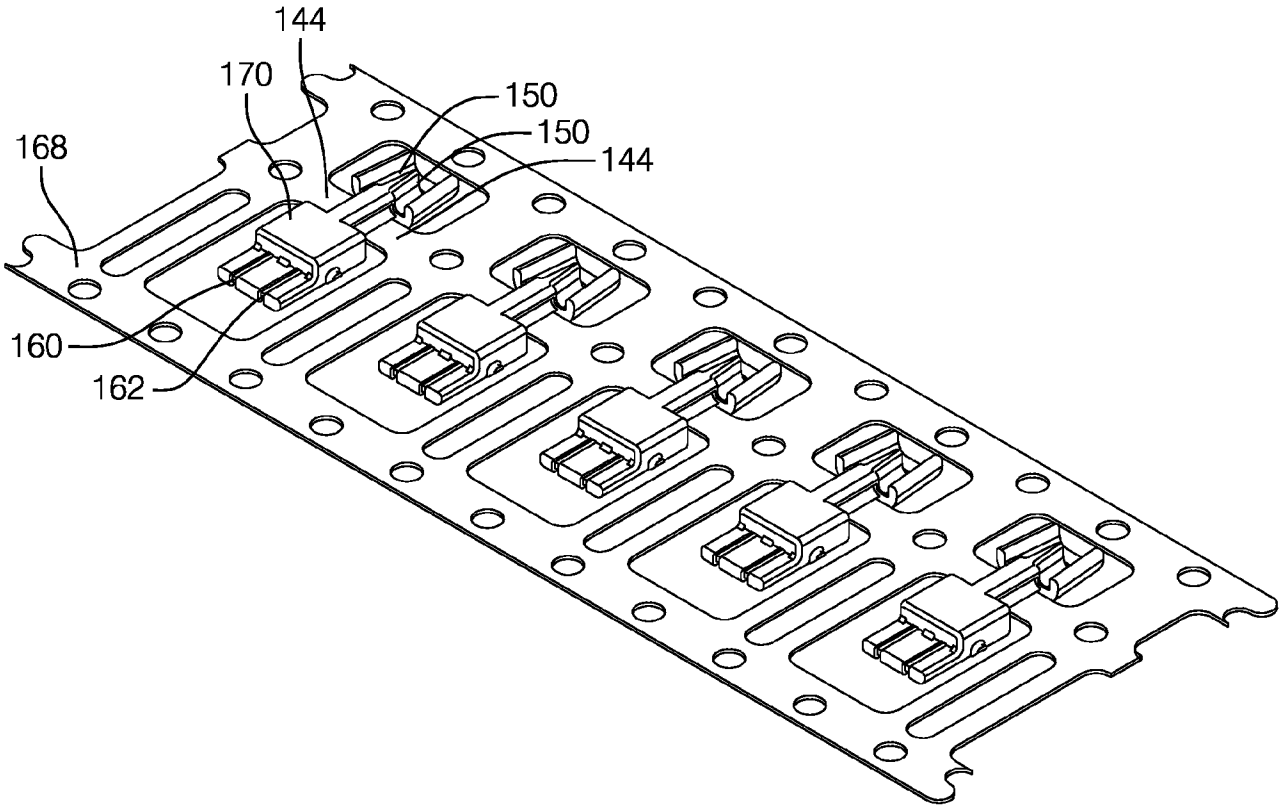
FIG. 20 is a perspective view of the plug terminals assembly of FIG. 19 encased within a plug terminal holder in accordance with one embodiment.

As illustrated in FIG. 20, the plug terminals remain attached to the carrier strip 168 for an insert molding process that forms a plug terminal holder 170 that partially encases the first and second plug terminals 160, 162. The plug terminal holder 170 maintains the spatial relationship between the first and second plug terminals 160, 162 after they are separated from the carrier strip 168. The plug terminal holder 170, similarly to the receptacle terminal holder 148, defines a pair of wire guide channels 150 that help to maintain a consistent separation between the first and second inner conductors 102, 104 as they transition from the wire cable 100 to the attachment portions 144 of the first and second receptacle terminals 132, 134. The plug terminal holder 170 is formed of a dielectric material, such as a liquid crystal polymer.

The carrier strip 168 is removed from the plug terminals prior to attaching the first and second inner conductors 102, 104 to first and second plug terminals 160, 162.

As illustrated in FIG. 18, the first and second inner conductors 102, 104 of the wire cable 100 are attached to the attachment portions 144 of the first and second plug terminals 160, 162 using an ultrasonic welding process.

As illustrated in FIGS. 13 and 14, the first and second plug terminals 160, 162 and the first and second receptacle terminals 132, 134 are oriented in the plug and receptacle connectors 128, 130 so that when the plug and receptacle connectors 128, 130 are mated, the major widths of the first and second receptacle terminals 132, 134 are substantially perpendicular to the major widths of the first and second plug terminals 160, 162. As used herein, substantially perpendicular means that the major widths are ±15° of absolutely perpendicular. The inventors have observed that this orientation between the first and second plug terminals 160, 162 and the first and second receptacle terminals 132, 134 has strong effect on insertion loss. Also, when the plug and receptacle connectors 128, 130 are mated, the first and second receptacle terminals 132, 134 overlap the first and second plug terminals 160, 162. The plug and receptacle connectors 128, 130 are configured so that only the first and second contact points 138, 142 of the first and second receptacle terminals 132, 134 contacts the planar blade portion of the first and second plug terminals 160, 162 and the contact area defined between the first and second receptacle terminals 132, 134 and the first and second plug terminals 160, 162 is less than the area overlapped between the first and second receptacle terminals 132, 134 and the first and second plug terminals 160, 162. Therefore, the contact area, sometimes referred to as the wipe distance, is determined by the area of the first and second contact points 138, 142 and not by the overlap between the terminals. Therefore, the receptacle and plug terminals provide the benefit of providing a consistent contact area as long as the first and second contact points 138, 142 of the first and second receptacle terminals 132, 134 are fully engaged with the first and second plug terminals 160, 162. Because the both the plug and receptacle terminals are a mirrored pair, a first contact area between the first receptacle terminal 132 and the first plug terminal 160 and a second contact area between the second receptacle terminal 134 and the second plug terminal 162 are substantially equal. As used herein, substantially equal means that the contact area difference between the first contact area and the second contact area is less than 0.1 $mm^2$. The inventors have observed through data obtained from computer simulation that the contact area between the plug and receptacle terminals and the difference between the first contact are a and the second contact area have a strong impact on insertion loss of the wire cable assembly.

The first and second plug terminals 160, 162 are not received within the first and second receptacle terminals 132, 134, therefore the first contact area is on the exterior of the first plug terminal 160 and the second contact area is on the exterior of the second plug terminal 162 when the plug connector 130 is mated to the receptacle connector 128.

The first and second receptacle terminals 132, 134 and the first and second plug terminals 160, 162 may be formed from a sheet of copper-based material. The first and second cantilever beam portions 136, 140 and the first and second planar portions 164, 166 may be selectively plated using copper/nickel/silver based plating. The terminals may be plated to a 5 skin thickness. The first and second receptacle terminals 132, 134 and the first and second plug terminals 160, 162 are configured so that the receptacle connector 128 and plug connector 130 exhibit a low insertion normal force of about 0.4 Newton (45 grams). The low normal force provides the benefit of reducing abrasion of the plating during connection/disconnection cycles.

As illustrated in FIG. 13, the plug connector 130 includes a plug shield 172 that is attached to the outer shield 124 of the wire cable 100. The plug shield 172 is separated from and longitudinally surrounds the first and second plug terminals 160, 162 and plug terminal holder 170. The receptacle connector 128 also includes a receptacle shield 174 that is attached to the outer shield 124 of the wire cable 100 that is separated from and longitudinally surrounds the first and second receptacle terminals 132, 134, receptacle terminal holder 148 and receptacle terminal cover 152. The receptacle shield 174 and the plug shield 172 are configured to slidingly contact one another and when mated, provide electrical continuity between the outer shields of the attached wire cables 100 and electromagnetic shielding to the plug and receptacle connectors 128, 130.

Figure 21:
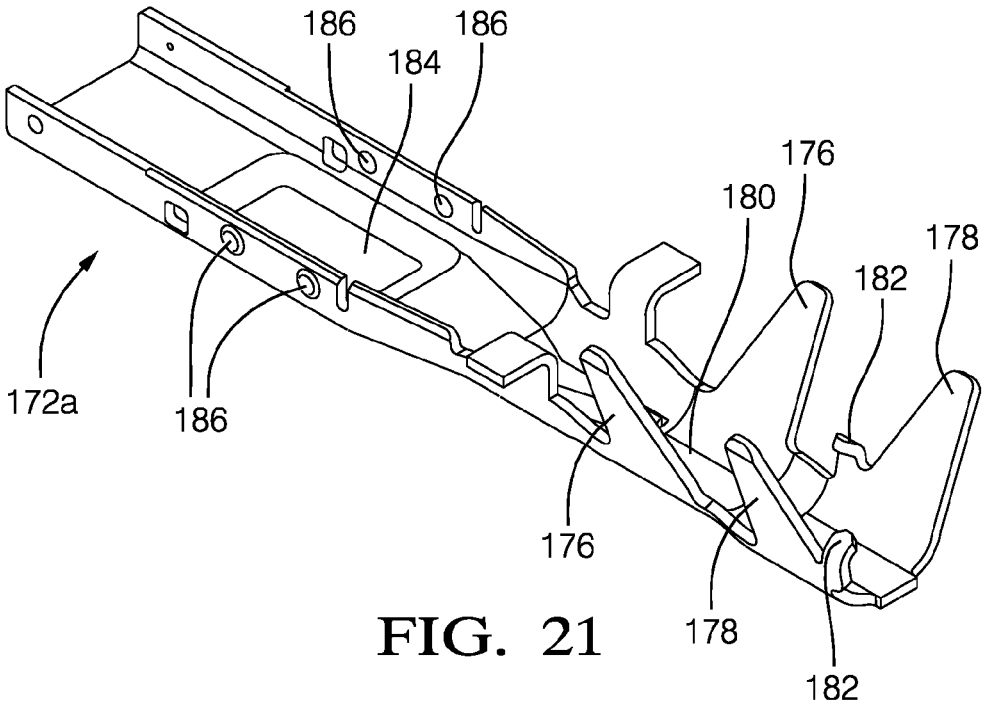
FIG. 21 is perspective view of a plug connector shield half of the wire cable assembly of FIG. 13 in accordance with one embodiment.
Figure 22:
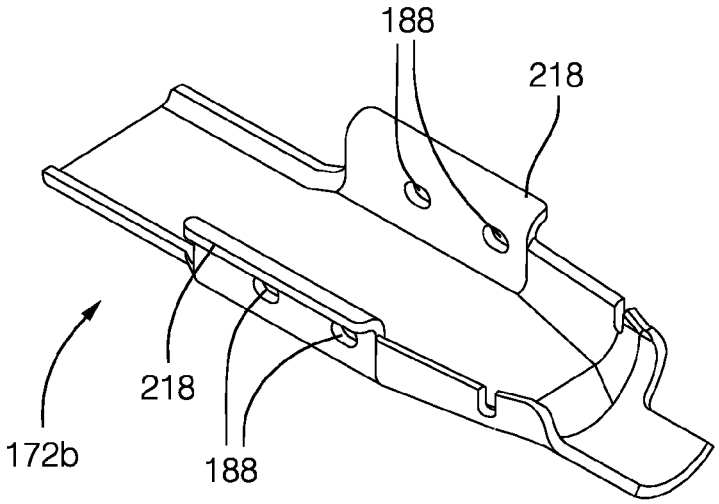
FIG. 22 is perspective view of another plug connector shield half of the wire cable assembly of FIG. 13 in accordance with one embodiment.

As shown in FIGS. 13, 21 and 22, the plug shield 172 is made of two parts. The first plug shield 172A illustrated in FIG. 21 includes two pairs of crimping wings, conductor crimp wings 176 and insulator crimp wings 178, adjacent an attachment portion 180 configured to receive the wire cable 100. The conductor crimp wings 176 are bypass-type crimp wings that are offset and configured to surround the exposed outer shield 124 of the wire cable 100 when the conductor crimp wings 176 are crimped to the wire cable 110. The drain wire 120*a* is electrically coupled to the first plug shield 172A when the first plug shield 172A is crimped to the outer shield 124 because the drain wire 120*a* of the wire cable 100 is sandwiched between the outer shield 124 and the inner shield 116 of the wire cable 110. This provides the benefit of coupling the plug shield 172 to the drain wire 120 without having to orient the drain wire 120 in relation to the shield before crimping.

The attachment portion 180 and the interior of the conductor crimp wings 176 may define a plurality of rhomboid indentations configured to improve electrical connectivity between the first plug shield 172A and the outer shield 124 of the wire cable 100. Such rhomboid indentations are described in U.S. Pat. No. 8,485,853, the entire disclosure of which is hereby incorporated by reference.

The insulation crimp wings are also bypass type wings that are offset and configured to surround the jacket 126 of the wire cable 100 when the plug shield 172 is crimped to the wire cable 110. The each of the insulation crimp wings further include a prong 182 having a pointed end that is configured to penetrate at least the outer insulator of the wire cable 100. The prongs 182 inhibit the plug shield 172 from being separated from the wire cable 100 when a force is applied between the plug shield 172 and the wire cable 100. The prongs 182 also inhibit the plug shield 172 from rotating about the longitudinal axis A of the wire cable 100. The prongs 182 may also penetrate the outer shield 124, inner shield 116, or belting 112 of the wire cable 100 but should not penetrate the first and second insulators 108, 110. While the illustrated example includes two prongs 182, alternative embodiments of the invention may be envisioned using only a single prong 182 define by the first plug shield 172A.

The first plug shield 172A defines an embossed portion 184 that is proximate to the connection between the attachment portions 144 of the plug terminals and the first and second inner conductors 102, 104. The embossed portion 184 increases the distance between the attachment portions 144 and the first plug shield 172A, thus decreasing the capacitive coupling between them.

The first plug shield 172A further defines a plurality of protrusions 218 or bumps 186 that are configured to interface with a corresponding plurality of holes 188 defined in the second plug shield 172B as shown in FIG. 22. The bumps 186 are configured to snap into the holes 188, thus mechanically securing and electrically connecting the second plug shield 172B to the first plug shield 172A.

Figure 23:
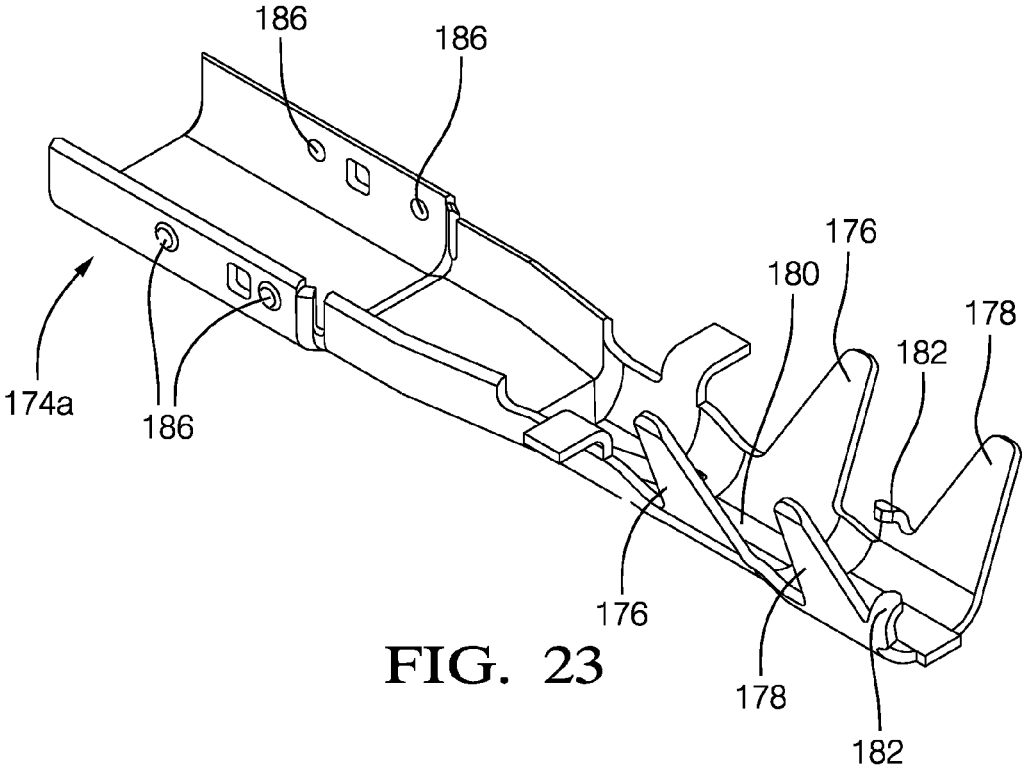
FIG. 23 is perspective view of a receptacle connector shield half of the wire cable assembly of FIG. 13 in accordance with one embodiment.
Figure 24:
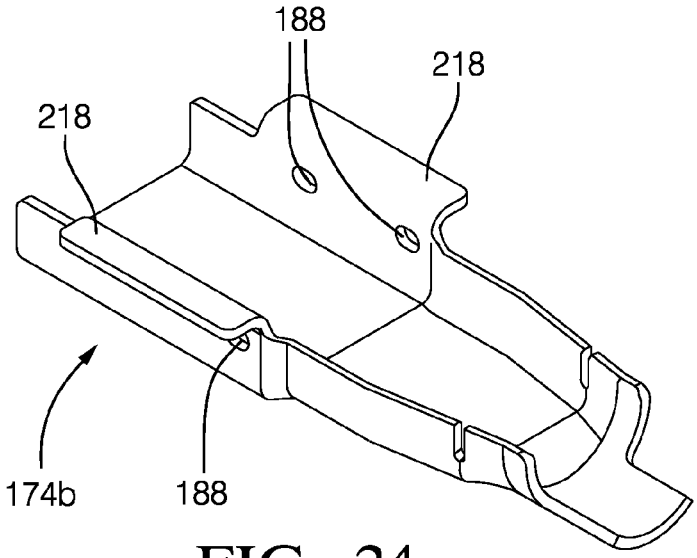
FIG. 24 is perspective view of another receptacle connector shield half of the wire cable assembly of FIG. 13 in accordance with one embodiment.

As shown in FIGS. 13, 23 and 24, the receptacle shield 174 is similarly made of two parts. The first receptacle shield 174A, illustrated in FIG. 23, includes two pairs of crimping wings, conductor crimp wings 176 and insulator crimp wings 178, adjacent an attachment portion 180 configured to receive the wire cable 110. The conductor crimp wings 176 are bypass-type crimp wings that are offset and configured to surround the exposed outer shield 124 of the wire cable 100 when the conductor crimp wings 176 are crimped to the wire cable 100. The attachment portion 144 and the interior of the conductor crimp wings 176 may define a plurality of rhomboid indentations configured to improve electrical connectivity between the first plug shield 172A and the outer shield 124 of the wire cable 100.

The insulation crimp wings are also bypass type wings that are offset and configured to surround the jacket 126 of the wire cable 100 when the plug shield 172 is crimped to the wire cable 100. The insulation crimp wings further include a prong 182 having a pointed end that is configured to penetrate at least the outer insulator of the wire cable 100. The prongs 182 may also penetrate the outer shield 124, inner shield 116, or belting of the wire cable 100. While the illustrated example includes two prongs 182, alternative embodiments of the invention may be envisioned using only a single prong 182.

The first receptacle shield 174A defines a plurality of protrusions 218 or bumps 186 that are configured to interface with a corresponding plurality of holes 188 defined in the second receptacle shield 174B securing the second receptacle shield 174 to the first receptacle shield 174A. The first receptacle shield 174A may not define an embossed portion proximate the connection between the attachment portions 144 of the first and second receptacle terminals 132, 134 and the first and second inner conductors 102, 104 because the distance between the connection and the receptacle shield 174 is larger to accommodate insertion of the plug shield 172 within the receptacle shield 174.

While the exterior of the plug shield 172 of the illustrated example is configured to slideably engage the interior of the receptacle shield 174, alternative embodiments may be envisioned wherein the exterior of the receptacle shield 174 slidably engages the interior of the plug shield 172.

The receptacle shield 174 and the plug shield 172 may be formed from a sheet of copper-based material. The receptacle shield 174 and the plug shield 172 may be plated using copper/nickel/silver or tin based plating. The first and second receptacle shield 174A, 174B and the first and second plug shield 172A, 172B may be formed by stamping processes well known to those skilled in the art.

While the examples of the plug connector and receptacle connector illustrated herein are connected to a wire cable, other embodiments of the plug connector and receptacle connector may be envisioned that are connected to conductive traces on a circuit board.

To meet the requirements of application in an automotive environment, such as vibration and disconnect resistance, the wire cable assembly 100 may further include a plug connector body 190 and a receptacle connector body 192 as illustrated in FIG. 12. The plug connector body 190 and the receptacle connector body 192 are formed of a dielectric material, such as a polyester material.

Returning again to FIG. 12, the receptacle connector body 192 defines a cavity 194 that receives the receptacle connector 128. The receptacle connector body 192 also defines a shroud configured to accept the plug connector body 190. The receptacle connector body 192 further defines a low profile latching mechanism with a locking arm 196 configured to secure the receptacle connector body 192 to the plug connector body 190 when the plug and receptacle connector bodies 190, 192 are fully mated. The plug connector body 190 similarly defines a cavity 198 that receives the plug connector 130. The plug connector body 190 defines a lock tab 200 that is engaged by the locking arm 196 to secure the receptacle connector body 192 to the plug connector body 190 when the plug and receptacle connector bodies 190, 192 are fully mated. The wire cable assembly 100 also includes connector position assurance devices 202 that hold the receptacle connector 128 and the plug connector 130 within their respective connector body cavities 194, 198.

Figure 27:
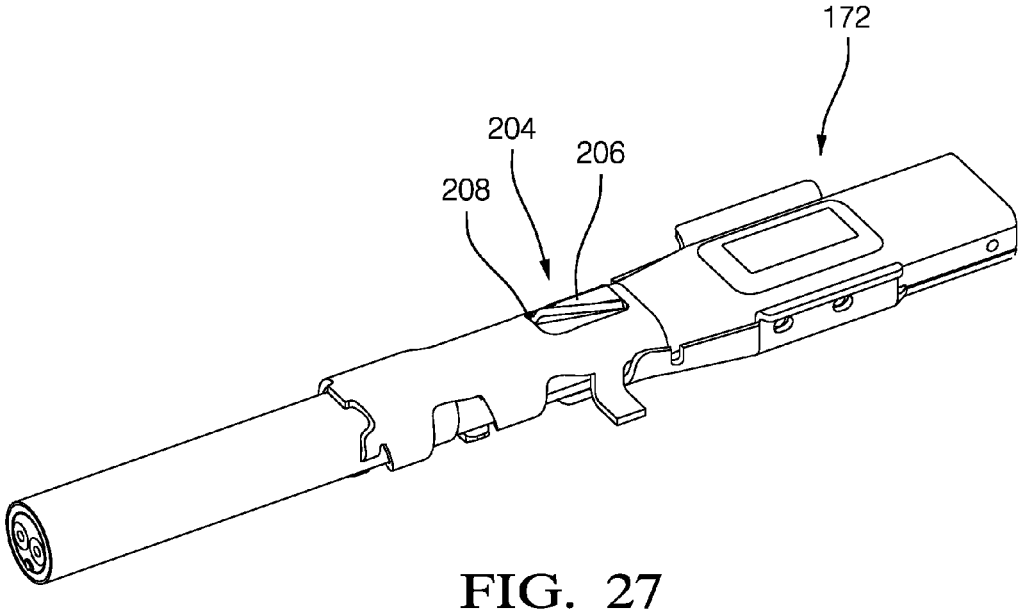
FIG. 27 is perspective view of the receptacle connector of the wire cable assembly of FIG. 12 in accordance with one embodiment.
Figure 28:
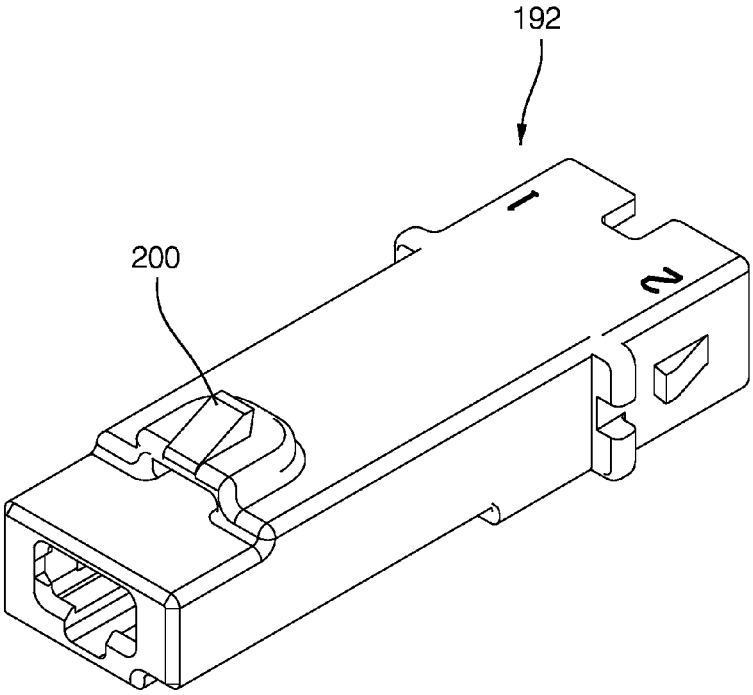
FIG. 28 is a perspective view of the receptacle connector body of the wire cable assembly of FIG. 12 in accordance with one embodiment.

As illustrated in FIG. 27, the first plug shield 172A defines a triangular lock tang 204 that protrudes from the first plug shield 172A and is configured to secure the plug connector 130 within the cavity 198 of the plug connector body 190. The lock tang 204 includes a fixed edge (not shown) that is attached to the first plug shield 172A, a leading edge 206 extends from the fixed edge and defines an acute angle relative to a longitudinal axis A of the plug shield 172, and a trailing edge 208 that also extends from the fixed edge is substantially perpendicular to the longitudinal axis A. The leading edge 206 and the trailing edge 208 protrude from the first plug shield 172A. As illustrated in FIG. 28, the cavity 198 of the plug connector body 190 includes a narrow portion 210 and a wide portion 212. When the plug connector 130 is initially inserted into the narrow portion 210, the leading edge 206 of the lock tang 204 contacts a top wall 214 of the narrow portion 210 and compresses the lock tang 204, allowing the plug connector 130 to pass through the narrow portion 210 of the cavity 198. When the lock tang 204 enters the wide portion 212 of the cavity 198, the lock tang 204 returns to its uncompressed shape. The trailing edge 208 of the lock tang 204 then contacts a back wall 216 of the wide portion 212 of the cavity 198, inhibiting the plug connector 130 from passing back through the narrow portion 210 of the plug connector body cavity 198. The lock tang 204 may be compressed so that the plug connector 130 may be removed from the cavity 198 by inserting a pick tool in the front of the wide portion 212 of the cavity 198.

Figure 25:
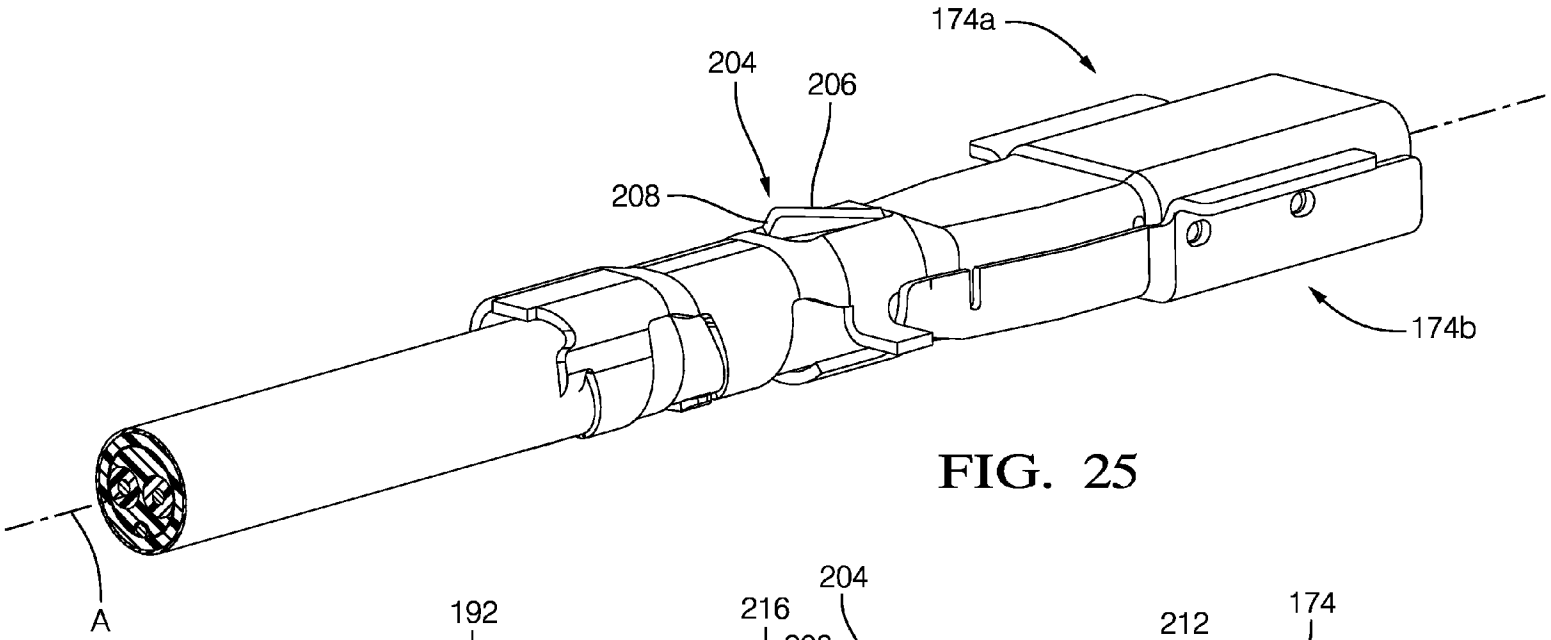
FIG. 25 is perspective view of the plug connector of the wire cable assembly of FIG. 12 in accordance with one embodiment.
Figure 26:
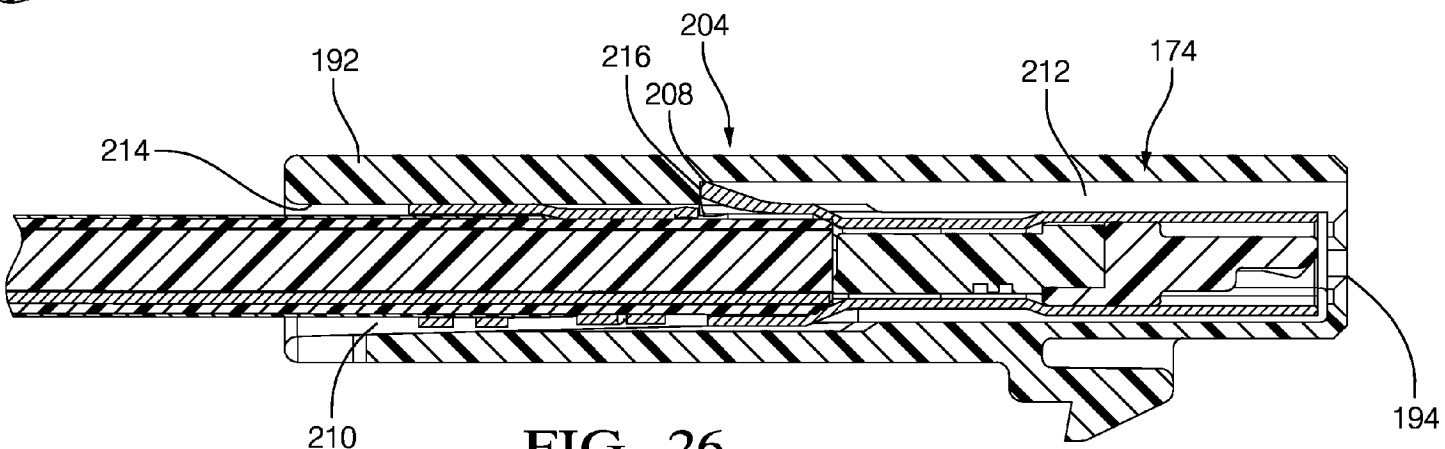
FIG. 26 is a cross sectional view of the receptacle connector body of the wire cable assembly of FIG. 12 in accordance with one embodiment.

As shown in FIG. 25, the receptacle shield 174 defines a similar lock tang 204 configured to secure the receptacle connector 128 within the cavity 194 of the receptacle connector body 192. The cavity 194 of the receptacle connector body 192 includes similar wide and narrow potions that have similar top walls and back walls. The lock tangs 204 may be formed during the stamping process of forming the first plug shield 172A and the first receptacle shield 174A.

Referring once again to FIG. 12, the receptacle shield 174 also includes a pair of protrusions 218 configured interface with a pair of grooves 220 defined in the side walls of the receptacle connector body cavity 194 to align and orient the receptacle connector 128 within the cavity 194 of the receptacle connector body 192. The plug shield 172 similarly defines a pair of protrusions 218 configured interface with a pair of grooves (not shown due to drawing perspective) defined in the side walls of the plug connector body cavity 198 to align and orient the plug connector 130 within the cavity 198 of the plug connector body 190.

While the examples of the receptacle and plug connector bodies 190, 192 illustrated in FIG. 12 include only a single cavity, other embodiments of the connector bodies may be envisioned that include a plurality of cavities so that the connector bodies include multiple plug and receptacle connectors 128, 130 or alternatively contain other connector types in addition to the plug or receptacle connectors 128, 130.

As illustrated in FIG. 28, the receptacle connector body 192 defines the lock tab 200 that extends outwardly from the receptacle connector body 192.

Figure 29:
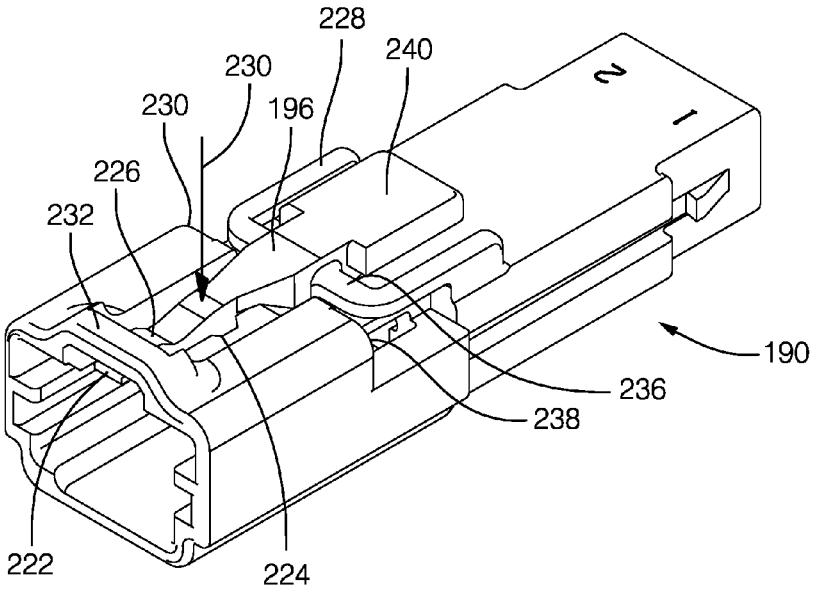
FIG. 29 is a perspective view of the plug connector body of the wire cable assembly of FIG. 12 in accordance with one embodiment.

As illustrated in FIG. 29, the plug connector body 190 includes a longitudinally extending lock arm 196. A free end 222 of the lock arm 196 defines an inwardly extending lock nib 224 that is configured to engage the lock tab 200 of the receptacle connector body 192. The free end 222 of the lock arm 196 also defines an outwardly extending stop 226. The lock arm 196 is integrally connected to the socket connector body by a resilient U-shaped strap 228 that is configured to impose a hold-down force 230 on the free end 222 of the lock arm 196 when the lock arm 196 is pivoted from a state of rest. The plug connector body 190 further includes a transverse hold down beam 232 integrally that is connected to the plug connector body 190 between fixed ends and configured to engage the stop 226 when a longitudinal separating force 234 applied between the receptacle connector body 192 and the plug connector body 190 exceeds a first threshold. Without subscribing to any particular theory of operation, when the separating force 234 is applied, the front portion 236 of the U-shaped strap 228 is displaced by the separating force 234 until the stop 226 on the free end 222 of the lock arm 196 contacts the hold down beam 232. This contact between the stop 226 and the hold down beam 232 increases the hold-down force 230 on the lock nib 224, thereby maintaining engagement of the lock nib 224 with the lock tab 200, this inhibiting separation of the plug connector body 190 from the receptacle connector body 192.

The plug connector body 190 further comprises a shoulder 238 that is generally coplanar with the U-shaped strap 228 and is configured to engage the U-shaped strap 228. Without subscribing to any particular theory of operation, when the separating longitudinal force applied between the receptacle connector body 192 and the plug connector body 190 exceeds a second threshold, the front portion 236 of the U-shaped strap 228 is displaced until the front portion 236 contacts the face of the shoulder 238 and thereby increases the hold-down force 230 on the lock nib 224 to maintain the engagement of the lock nib 224 with the lock tab 200. The separating force 234 at the second threshold is greater than the separating force 234 at the first threshold. Because the stop 226 and the U-shaped strap 228 help to increase the hold-down force 230, it is possible to provide a connector body having a low-profile locking mechanism that is capable of resisting a separating force using a polyester material that can meet automotive standards.

Figure 30:
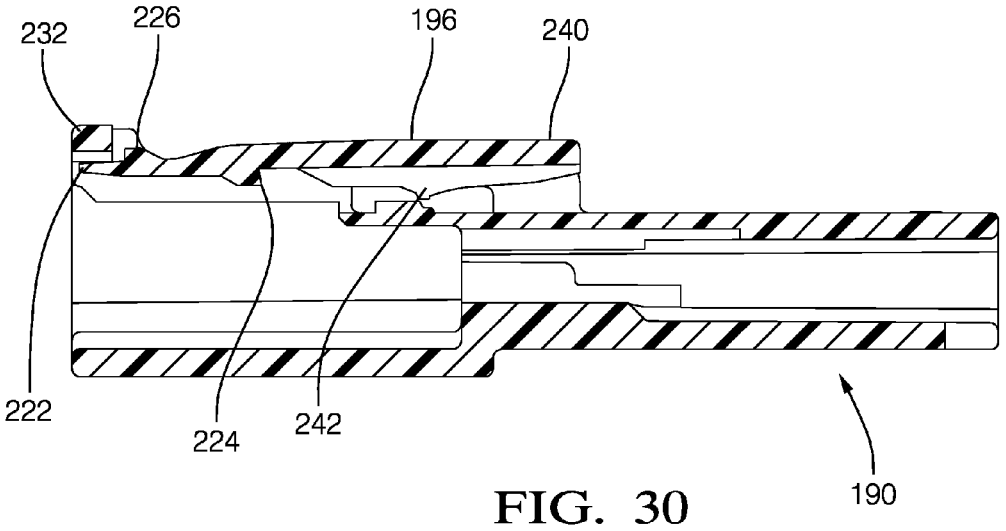
FIG. 30 is cross sectional view of the plug connector of the wire cable assembly of FIG. 12 in accordance with one embodiment.
Figure 31:
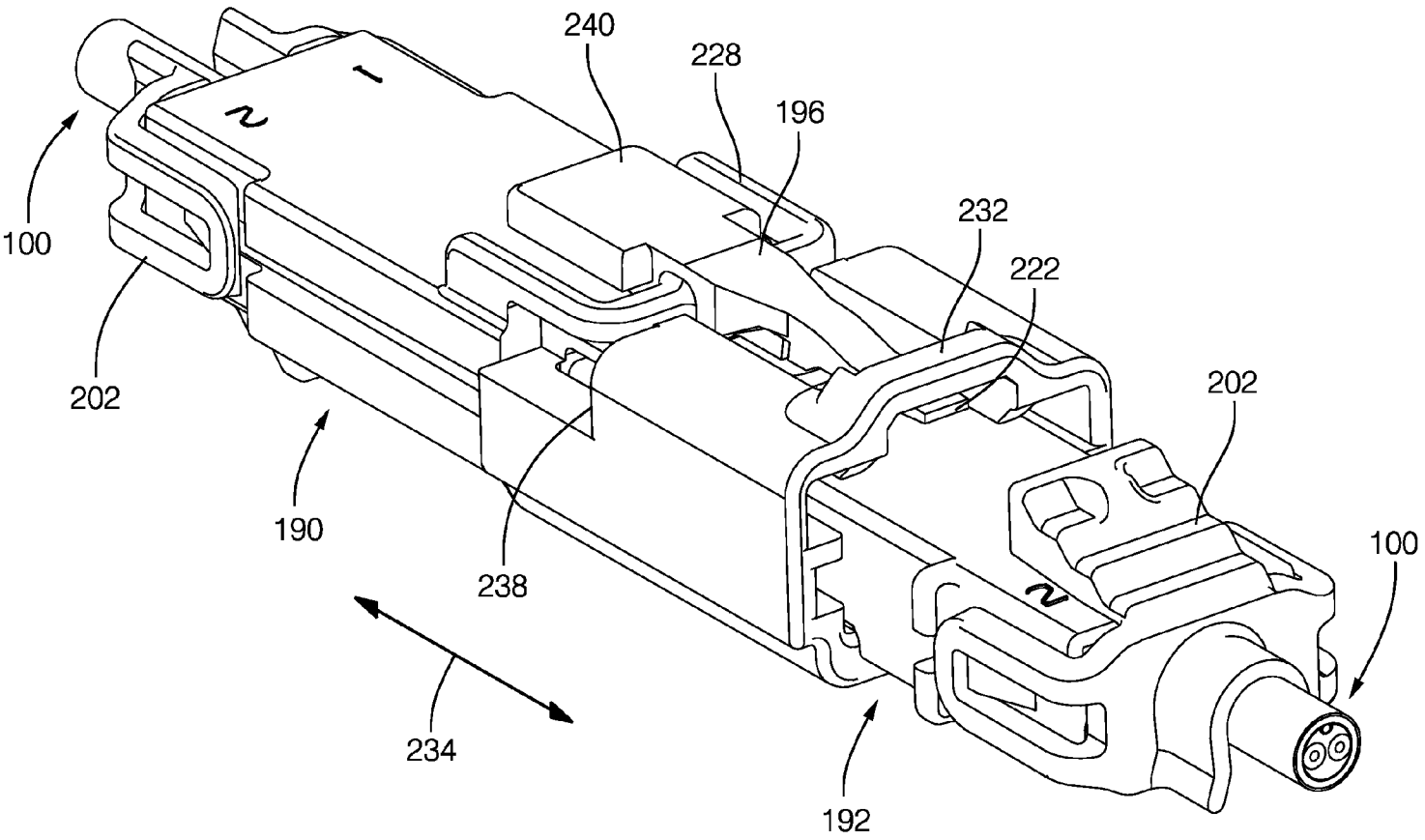
FIG. 31 is a perspective view of the wire cable assembly of FIG. 12 in accordance with one embodiment.
Figure 32:
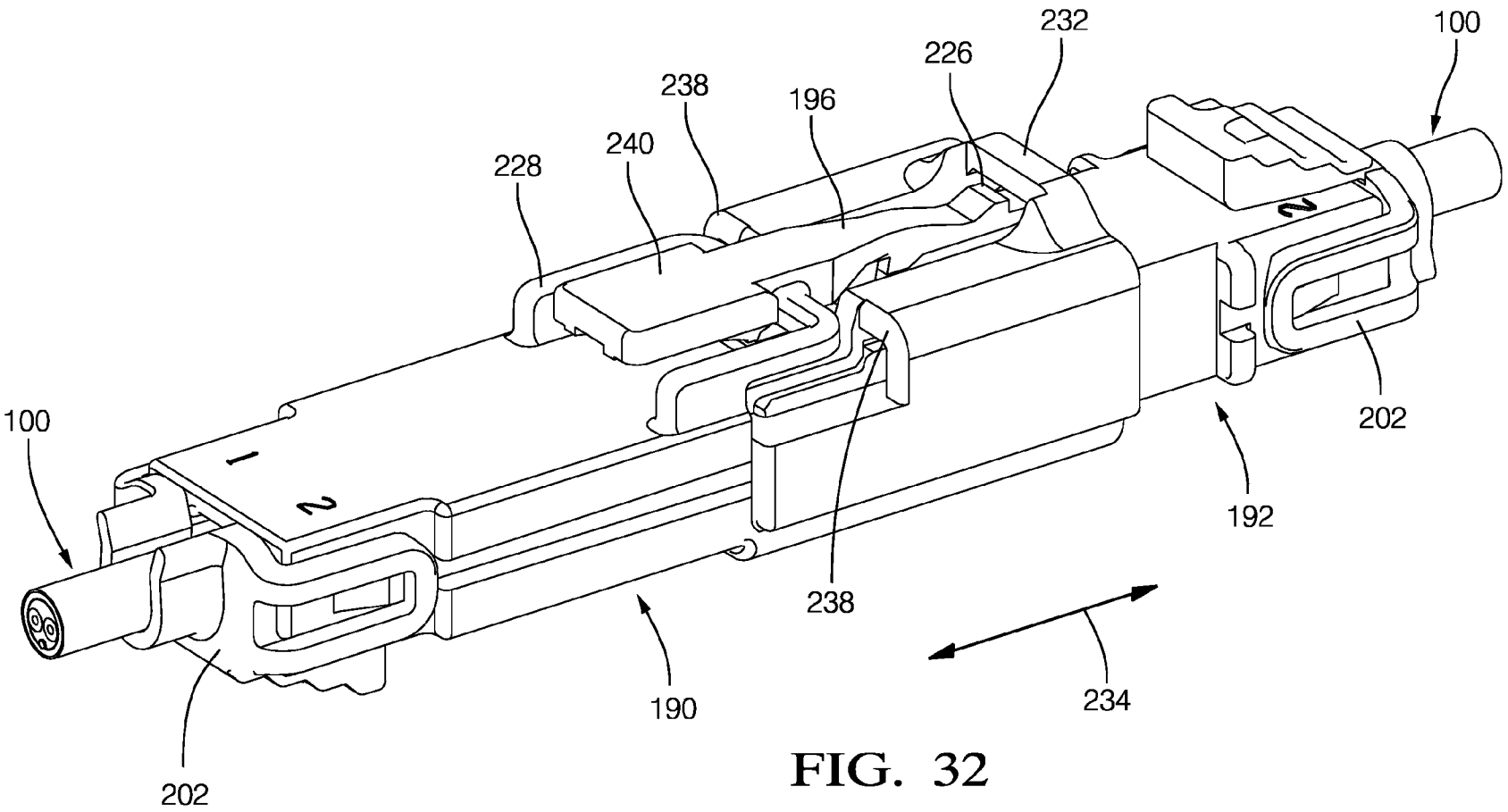
FIG. 32 is an alternative perspective view of the wire cable assembly of FIG. 12 in accordance with one embodiment.
Figure 33:
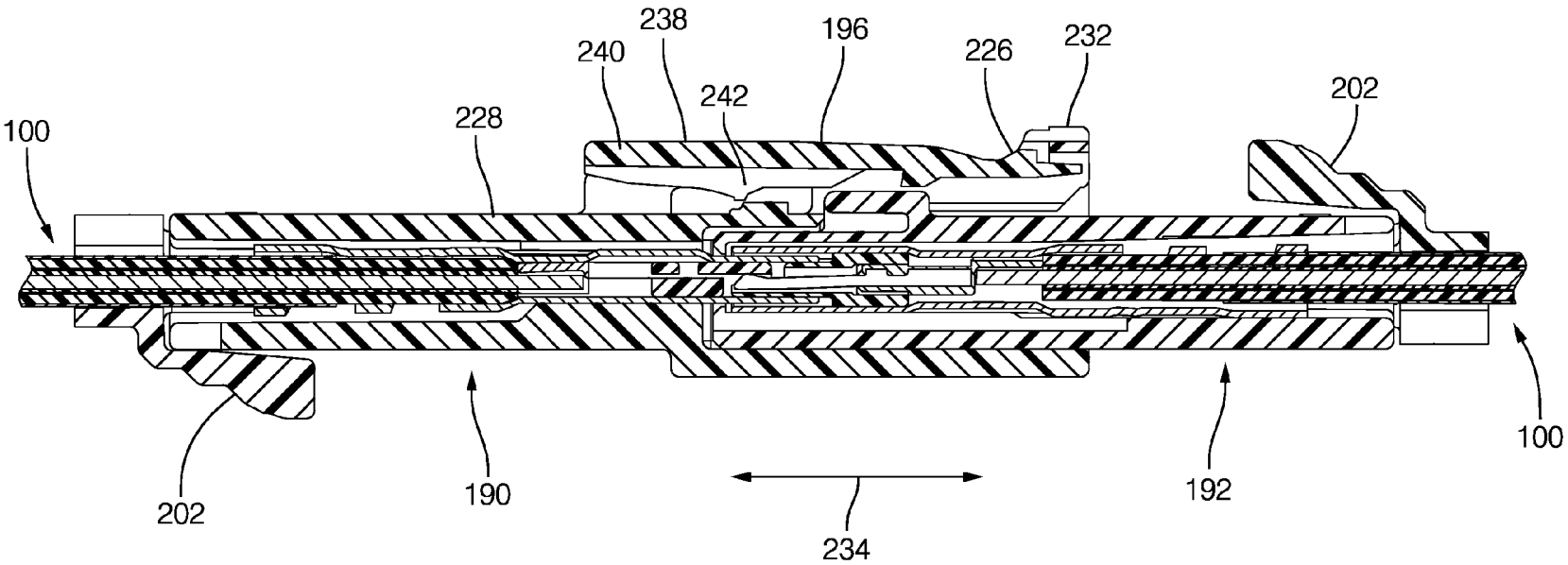
FIG. 33 is a cross sectional view of the wire cable assembly of FIG. 12 in accordance with one embodiment.
Figure 34:
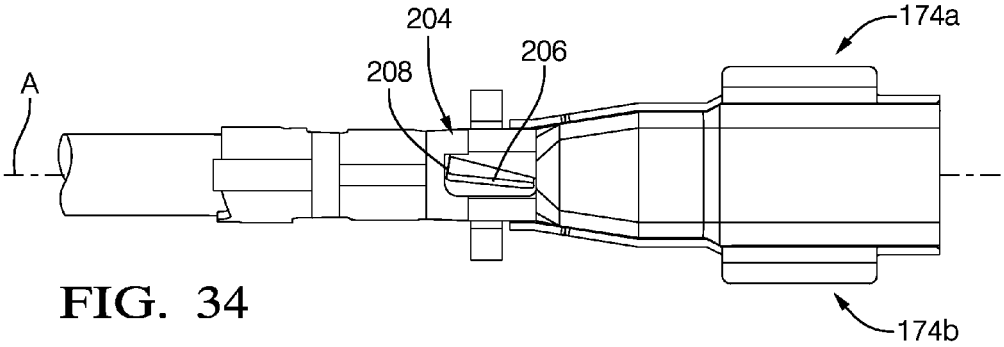
FIG. 34 is top view of the receptacle connector of the wire cable assembly of FIG. 25 in accordance with one embodiment.
Figure 35:
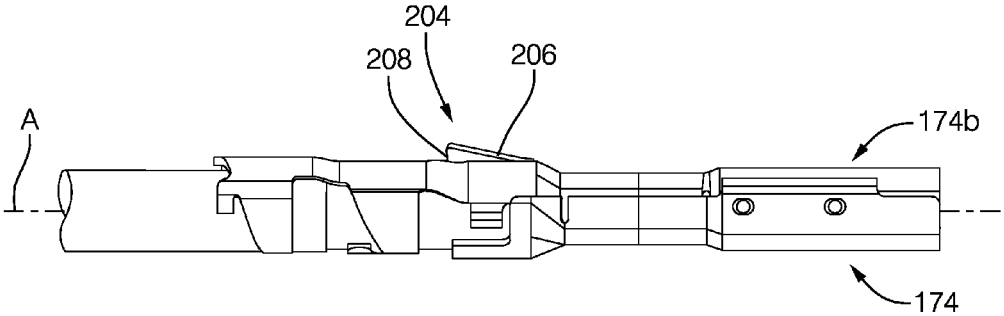
FIG. 35 is perspective view of the receptacle connector of the wire cable assembly of FIG. 25 in accordance with one embodiment.
Figure 36:
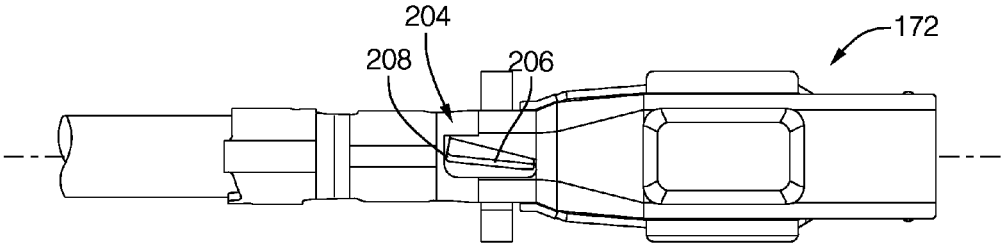
FIG. 36 is top view of plug connector of the wire cable assembly of FIG. 27 in accordance with one embodiment.
Figure 37:
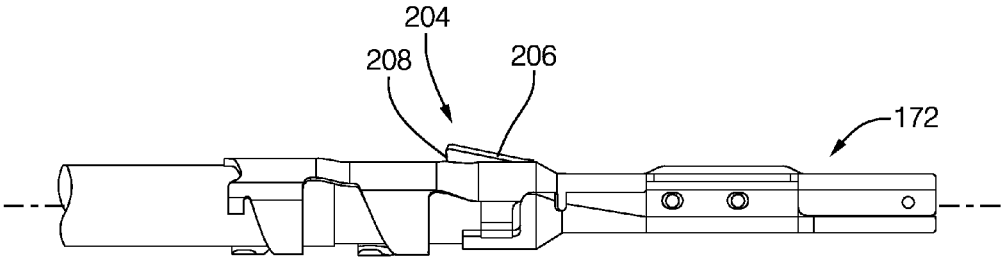
FIG. 37 is side view of the plug connector of the wire cable assembly of FIG. 27 in accordance with one embodiment.

The lock arm 196 also includes a depressible handle 240 that is disposed rearward of the U-shaped strap 228. The lock nib 224 is moveable outwardly away from the lock tab 200 by depressing the handle to enable disengagement of the lock nib 224 with the lock tab 200. As illustrated in FIG. 30, the lock arm 196 further includes an inwardly extending fulcrum 242 disposed between the lock nib 224 and the depressible handle 240.

Accordingly, a wire cable assembly 100*a*-100*c* is provided. The wire cable 100*a*-100*c* is capable of transmitting digital data signals with data rates of 5 Gb/s or higher. The wire cable 100*a*-100*c* is capable of transmitting signals at this rate over a single pair of conductors rather than multiple twisted pairs as used in other high speed cables capable of supporting similar data transfer rates, such as Category 7 cable. Using a single pair as in wire cable 100*a*-100*c* provides the advantage of eliminating the possibility for cross talk that occurs between twisted pairs in other wire cables 100*a* having multiple twisted pairs. The single wire pair in wire cable 100*a*-100*c* also reduces the mass of the wire cable 100*a*-100*c*; an important factor in weight sensitive applications such as automotive and aerospace. The belting 112 between the first and second conductors 102*a*, 104*a*, 102*b*, 104*b* and the inner shield 116 helps to maintain a consistent radial distance between the first and second conductors 102*a*, 104*a*, 102*b*, 104*b* and the inner shield 116 especially when the cable is bent as is required in routing the wire cable 100*a*-100*c* within an automotive wiring harness assembly. Maintaining the consistent radial distance between the first and second conductors 102*a*, 104*a*, 102*b*, 104*b* and the inner shield 116 provides for consistent cable impedance and more reliable data transfer rates. The belting 112 and the bonding of the first and second insulators 108, 110 helps to maintain the twist angle Θ between the first and second conductors 102*a*, 104*a*, 102*b*, 104*b* in the wire pair, again, especially when the cable is bent by being routed through the vehicle at angles that would normally induce wire separation between the first and second conductor 102, 104. This also provides consistent cable impedance. The receptacle connectors 128 and plug connectors 130 cooperate with the wire cable to provide consistent cable impedance. Therefore, it is a combination of the elements, such as the bonding of the first and second insulators 108, 110 and the belting 112, the inner shield 116, the terminals 132, 134, 160, 162 and not any one particular element that provides a wire cable assembly 100*a*-100*c* having consistent impedance and insertion loss characteristic that is capable of transmitting digital data at a speed of 5 Gb/s or more, even when the wire cable 100*a*-100*c* is bent.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

We claim:

1. An electrical connector shield configured to be attached to an end of a shielded wire cable having a conductive wire cable and a shield conductor longitudinally surrounding the conductive wire cable that is separated from the conductive wire cable by an inner insulator, said shielded wire cable further having an insulative jacket at least partially surrounding the shield conductor, said electrical connector shield comprising:

a connection portion configured for connection with a corresponding mating electrical connector shield, wherein the connection portion defines a shroud configured to longitudinally surround an electrical terminal attached to the conductive wire cable; and an attachment portion having a conductor crimp wing configured for attachment to an end of the shield conductor and an insulator crimp wing configured for attachment to an end of the insulative jacket, wherein the shroud defines an embossment proximate a location of a connection between the electrical terminal and the conductive wire cable and wherein the embossment projects outwardly to increase a distance between the connection and the shroud.

2. The electrical connector shield according to claim 1, wherein the insulator crimp wing defines a prong having a pointed end that is configured to penetrate the insulative jacket.

3. The electrical connector shield according to claim 1, wherein the electrical connector shield is configured to be disposed within a cavity of an electrical connector body, wherein the electrical connector shield defines a triangular lock tang having three edges defined by a first fixed edge on the electrical connector shield, a first free edge extending from the electrical connector shield that defines an acute angle relative to a longitudinal axis of the electrical connector shield, and a second free edge also extending from the electrical connector shield that substantially defines a right angle relative to the longitudinal axis, wherein the second free edge is configured to engage a lock edge within the cavity of the electrical connector body, thereby inhibiting removal of the electrical connector shield from the cavity, and wherein the first free edge and the second free edge protrude from the electrical connector shield.

4. An electrical connector shield configured to be attached to an end of a shielded wire cable having a shield conductor longitudinally surrounding a conductive wire cable and separated from the conductive wire cable by an inner insulator and further having an insulative jacket at least partially surrounding the shield conductor and further configured to be disposed within a cavity of an electrical connector body, said electrical connector shield comprising:

a connection portion configured for connection with a corresponding mating electrical connector shield;

an attachment portion configured for attachment to the shield conductor, wherein the attachment portion defines a triangular lock tang having three edges defined by a first fixed edge on the electrical connector shield, a first free edge extending from the electrical connector shield that defines an acute angle relative to a longitudinal axis of the electrical connector shield, and a second free edge also extending from the electrical connector shield that substantially defines a right angle relative to the longitudinal axis, wherein the second free edge is configured to engage a lock edge within the cavity of the electrical connector body, thereby inhibiting removal of the electrical connector shield from the cavity and wherein the first free edge and the second free edge protrude from the attachment portion; and wherein the connection portion defines a shroud configured to longitudinally surround an electrical terminal attached to the conductive wire cable; the shroud defines an embossment proximate a location of a connection between the electrical terminal and the conductive wire cable, wherein the embossment projects outwardly to increases a distance between the connection and the shroud.

* * * * *